US005205496A

United States Patent [19]

O'Donnell et al.

[11] Patent Number: 5,205,496

[45] Date of Patent: Apr. 27, 1993

[54] UNIVERSAL GRINDER WITH RECIPROCAL FEEDER

[75] Inventors: Ralph T. O'Donnell, Loveland, Colo.; Donald A. Egging; James G. Nickels, both of Sydney, Nebr.; William A. Eddy, Houston, Tex.

[73] Assignee: O.D.E. Investments Corporation, Greeley, Colo.

[21] Appl. No.: 711,048

[22] Filed: Jun. 5, 1991

[51] Int. Cl.[5] ..... B02C 23/00

[52] U.S. Cl. ..... 241/34; 241/152.2; 241/186.2; 241/282

[58] Field of Search ..... 241/34, 64, 95, 88.4, 241/191, 185.5, 282, 186.2, 152.2, 605, 101 A

[56] References Cited

U.S. PATENT DOCUMENTS

| | | | |
|---|---|---|---|
| 822,765 | 6/1906 | Perkins | 241/152.2 X |
| 1,394,725 | 10/1921 | Frick | 241/152.2 |
| 1,713,507 | 5/1929 | Ammon | 241/191 |
| 1,864,973 | 6/1932 | Buchanan | 241/191 X |
| 2,645,500 | 7/1953 | Moss . | |
| 2,650,745 | 9/1953 | Oberwortman . | |
| 2,810,529 | 10/1957 | Jensen . | |
| 3,615,059 | 10/1971 | Moeller . | |
| 3,743,191 | 7/1973 | Anderson . | |
| 3,817,462 | 6/1974 | Hamlin . | |
| 3,912,175 | 10/1975 | Anderson . | |
| 3,966,128 | 6/1976 | Anderson et al. . | |
| 3,972,484 | 8/1976 | Ryan | 241/605 X |
| 4,003,502 | 1/1977 | Barcell . | |
| 4,083,501 | 4/1978 | Ryan | 241/605 X |
| 4,085,897 | 4/1978 | Hahn et al. | 241/186.2 X |
| 4,087,051 | 5/1978 | Moeller . | |
| 4,106,706 | 8/1978 | Burrows . | |
| 4,165,045 | 8/1979 | Hager et al. | 241/282 |
| 4,412,659 | 11/1983 | Crawford et al. . | |
| 4,505,434 | 3/1985 | Martenas et al. | 241/95 X |
| 4,773,061 | 9/1988 | Urich et al. . | |

FOREIGN PATENT DOCUMENTS

| | | | |
|---|---|---|---|
| 2621835 | 4/1989 | France | 241/152 A |
| 3039648 | 2/1988 | Japan | 241/282 |
| 982797 | 12/1982 | U.S.S.R. | 241/282 |
| 1349786 | 11/1987 | U.S.S.R. | 241/282 |

OTHER PUBLICATIONS

AL-KO Shredders product brochure manufactured by AL-KO Corporation.

Owners Manual & Illustrated Parts List for the "Renegade 250" Chipper/Shredder Grinder, manufactured by WW Grinder Inc.

Promark Model 310 Brush Chipper product brochure manufactured by Promark Products, Inc.

Lindig XK9 Kajon, Q24 and CQ Concho chippers product brochure manufactured by Lindig Manufacturing Corporation.

*Primary Examiner*—Timothy V. Eley
*Assistant Examiner*—Frances Chin
*Attorney, Agent, or Firm*—James R. Young

[57] ABSTRACT

A hammer mill apparatus for comminuting materials such as wood, branches, twigs, leaves, grasses, hay, and the like, features a reciprocating batch feeder for feeding the materials to be comminuted into a rotary grinder. Adjustable and spring biased feed drum and metering roller meters the material into the hammer mill. The positions of a series of adjustable curved grinding teeth changes the sizes of the comminuted particles.

35 Claims, 10 Drawing Sheets

UNIVERSAL GRINDER WITH RECIPROCAL FEEDER

BACKGROUND OF THE INVENTION

1. Field of the Invention

This invention is generally related to grinding apparatus, and more specifically to a relatively small scale, reasonably priced method and apparatus for comminuting a wide variety of different kinds of materials.

2. Brief Description of the Prior Art

Grinding mills have been utilized for many years in a variety of applications. For example, grinding mills have been commonly used in the past for grinding grains, corn, hay, and other forage materials for livestock feed, as well as paper for cellulose insulation and other commercial uses. Many varieties of grinding mills for comminuting such materials have been developed, such as stone mills, burr mills, hammer mills, and roller mills. However, few, if any, reasonably priced and reasonably sized grinders are available that can handle effectively and efficiently a variety of different kinds of materials, for example, ranging from grains to forage to wood.

Because forage materials and wood, including tree branches, tend to be fibrous and stalky, hammer mill type grinders have been found to be the most effective in comminuting these forage or roughage materials. However, handling and feeding these bulky, fibrous, stalky materials into a hammer mill in a uniform manner proved to be quite difficult and required a good deal of tedious manual labor, because they do not flow in a uniform manner like grains.

Some of the more successful recent developments in grinding apparatus to alleviate the problems in feeding bulky, fibrous, and stalky materials into hammer mills include the relatively large grinders now known generically as tub grinders because of the characteristic rotating tub-shaped feeders. Tub grinders were designed initially to feed very large bales of hay and other forage materials into hammer mill apparatus without the need for excessive manual labor. In a typical tub grinder, the hammer mill cylinder is positioned under and extends partially through the floor or bottom of the tub, and the rotating tub feeds the bottom of the bale or pile of material to be comminuted over the hammer mill. The hammers on the hammer mill cylinder rotate at a high angular velocity and chew off the forage on the bottom of the bale as the base of the bale rotates over the hammer mill cylinder in the floor of the tub. Typical examples of such tub grinders can be found in the following patents: U.S. Pat. No. 2,650,745, issued to W. Oberwortman, U.S. Pat. No. 3,615,059, issued to E. Moeller; U.S. Pat. No. 3,743,191, issued to R. Anderson; U.S. Pat. No. 3,912,175, issued to R. Anderson; U.S. Pat. No. 3,966,128, issued to J. Anderson, et al.; U.S. Pat. No. 4,003,502, issued to E. Barcell; U.S. Pat. No. 4,087,051, issued to C. Moeller; and U.S. Pat. No. 4,106,706, issued to H. Burrows.

Tub grinders have been found to be quite effective for grinding not only large bales of hay, but also for grinding large quantities of forage or roughage materials. Therefore, with the exception of expensive, large, stationary grinders in more or less permanent industrial grinding installations with special, custom designed conveyors and other feed apparatus for specific purposes, the tub grinders have become somewhat of a standard for larger, portable, mid-priced, general purpose grinding machines. Consequently, when recent environmental ordinances and regulations began to prohibit dumping of bulk, unprocessed yard wastes, grass clippings, branches, construction waste, paper, and the like into community landfills, the larger operators began to use tub grinders for comminuting such materials before hauling them to landfills. Such tub grinders have now been used with marginal success for comminuting such bulky materials, which are commonly referred to as commercial or industrial waste, where large quantities of such materials have to be handled, and particularly where the materials are dumped into the hammer mill in batches. In response to this need, several manufacturers have now started making special, heavy duty tub grinders for comminuting such commercial and industrial wastes, because the conventional agricultural tub grinders made for grinding hay proved to be too light, and they break down or wear out too fast when used for comminuting such commercial and industrial wastes.

While the tub grinders and other specialized grinder apparatus are filling a need for large-scale users, as described above, they are too large and expensive to meet the needs of small-scale users, who are also required to comminute their yard wastes, grass clippings, branch prunings, waste wood, leaves, waste paper, assorted rubbish, and the like into more readily decomposable form before dumping them into community landfills or using them as compost materials. Therefore, there is a steadily increasing need for an economical, light-duty, commercial grinder or miller that is capable of grinding such materials more reliably and efficiently. Such a grinder should be capable of reliably grinding all types of shreddable or comminutable materials such as paper, cardboard, clay, wood, branches, yard waste, bark, wet leaves, grass clippings, weeds, plastic, tin and aluminum cans, and other common waste materials, yet not jam when certain non-comminutable material, such as chunks of metal, rock, or concrete might accidently find their way into the mill. Because small-scale users, such as landscapers, grounds keepers, and the like also often need to grind hay or straw for compost or for ground cover in newly seeded areas, the grinder should also be able to handle those kinds of needs. It would be even more beneficial if it could also handle rubbish and even grains for users who have a variety of needs.

Further, because of the varying nature of the homogeneity of such a wide variety of materials, from the irregular and stocky nature of branches, to the dense, resilient nature of wet paper and grass, to small, uniformly sized kernels of grain, the grinder should be capable of reliably and evenly feeding quantities of such materials uniformly and efficiently into the hammer mill rotor for comminuting all such materials to desired particle sizes and consistencies. There are smaller scale grinding machines available for each such special purpose. For example, there are small scale wood chippers available for handling branches. There are hammer mills available for handling hay or straw. There are also hammer mills available for handling grains. However, there are few, if any, hammer mills available for handling wet leaves, grass clippings, and waste paper, and there has not been any single machine available that can handle reliably and comminute efficiently and effectively a wide variety of such materials on a reliable small or light duty scale. The U.S. Pat. No. 4,773,601, developed by one of the joint inventors of the grinder in the present patent application was an attempt to do so by providing a small-scale rotating tub feeder that was interchangeable with a hand-feeder chute for branches. While that small-scale tub grinder and wood chipper combination has some useful features and solved some significant problems, there are still shortcomings. For example, the small rotating tub just does not work as well as large tubs for feeding wet leaves, grass clippings, hay, straw, waste paper, and the like. It tends to bridge or to feed in slugs, rather than a smooth, even feed, and the feed roller tends to fill and clog with wet leaves and muddy grass clippings. The small tub is also too small for receiving batch dumps of such materials from a front end loader or similar machines that are normally used for handling such materials in smaller or medium scale commercial operations. Also, the chute is only good for hand-feeding branches and wood into the grinder. The comminuting mechanism itself of the grinder in U.S. Pat. No. 4,773,601 also has some deficiencies. For example, the aligned hammers tend to carve grooves in larger branches and pieces of wood, thereby inhibiting feeding, and some fibrous sheet materials, such as cardboard boxes, are not ground in a very effective manner. Therefore, there is much room for improvement, and there is still a substantial need for a small-scale or light-duty grinder that can handle a wide variety of commercial and industrial wastes as well as agricultural and feed products reliably, efficiently, and effectively.

SUMMARY OF THE INVENTION

Accordingly, it is a general object of the present invention to provide a light-duty commercial hammer mill that is capable of handling and comminuting branches, brush, twigs, and the like, into wood chips, and grass clippings, leaves, waste paper, and the like into compostable material, as well as comminuting more homogenous materials, such as hay, corn, or other feed grains.

A more specific object of this invention is to provide a comminuting apparatus with a reciprocating linear feeder system that can receive batch dumps of commercial wastes or agricultural materials and feed a wide variety of such materials effectively and uniformly into a hammer mill without slugging or jamming, so that a relatively small horsepower tractor engine can be used to drive the apparatus.

Another specific object of this invention is to provide a hammer mill that can be used effectively as a wood chipper.

Another specific object of this invention is to provide a hammer mill having sufficient feed and milling controls and adjustments to accommodate a wide variety of shreddable materials, and to comminute such materials into particles having selectively variable sizes.

Additional objects, advantages, and novel features of this invention are set forth in part in the description that follows, and in part will become apparent to those skilled in the art upon examination of the following specification or may be learned by the practice of the invention. The objects and advantages of the invention may be realized and obtained by means of the instrumentalities and in combinations particularly pointed out in the appended claims.

To achieve the foregoing and other objects and in accordance with the purpose of the present invention, as embodied and broadly described herein, the apparatus of this invention may comprise a rotary hammer mill rotatably mounted in a housing that encloses a milling chamber and reciprocating feed apparatus capable of feeding a variety of materials to be comminuted radially into the rotary hammer mill. The reciprocating feed apparatus includes an adjustable, cylindrical feed drum with a plurality of spaced apart teeth on its peripheral surface positioned in a horizontal feed chute and preferably a smaller metering roller adjacent the feed drum for metering the material into the grinding chamber. The positions of the feed drum and metering roller in the chute entrance are adjustable to accommodate various types of comminutable materials and may be biased toward the chute to enhance clamping control, metering of brush and branches radially into the hammer mill rotor, and to allow occasional chunks of non-comminutable material to pass. Both the bias and the spacing or positioning of the feed drum and metering roller are adjustable. A linear reciprocating feed plate slidably mounted in the horizontal feed chute feeds the material steadily and positively into the feed drum and rotor on a batch basis. The width of the feed chute is preferably just wide enough to easily accommodate a conventional hay or straw bale and long enough to receive a dump of material from a conventional front end loader bucket. Cycle controls are used to cycle the feed plate in a manner that accommodates batch reception of the material to be comminuted, for example from a front end loader. A specially designed hammer mill rotor enhances complete comminuting of a variety of materials, including logs, and increases wind draw through the grinding chamber.

BRIEF DESCRIPTION OF THE DRAWINGS

The accompanying drawings, which are incorporated herein and form a part of the specification illustrate the preferred embodiments of the present invention, and together with the description, serve to explain the principles of the invention. In the drawings.

DETAILED DESCRIPTION OF THE PREFERRED EMBODIMENT

Figure 1:
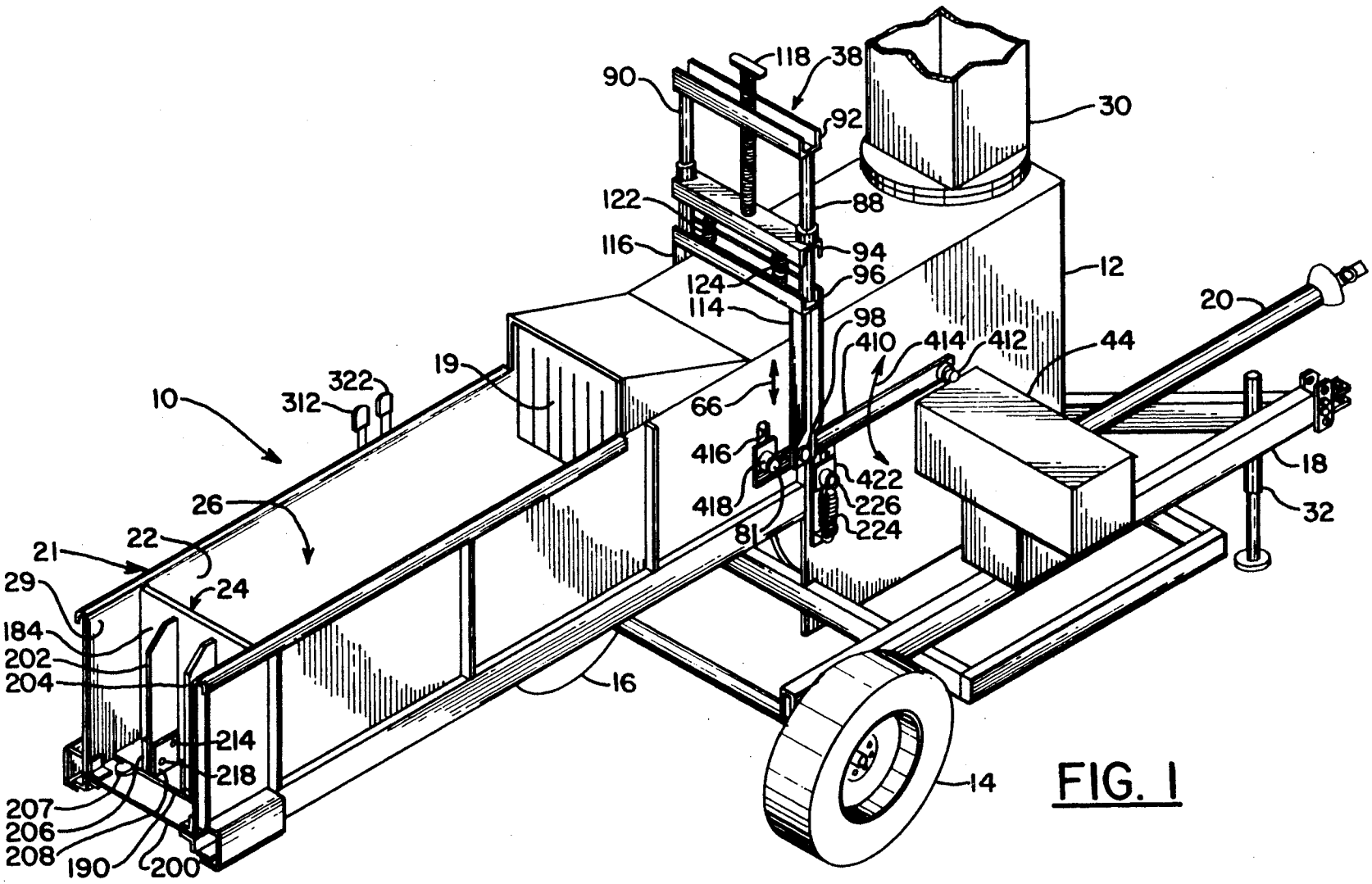
FIG. 1 is an isometric perspective view of the combination grinder and wood chipper hammer mill according to the present invention illustrating the horizontal feed chute, reciprocating feed plate, and the adjustable, biased mounting for the cylindrical feed drum and metering roller.
Figure 2:
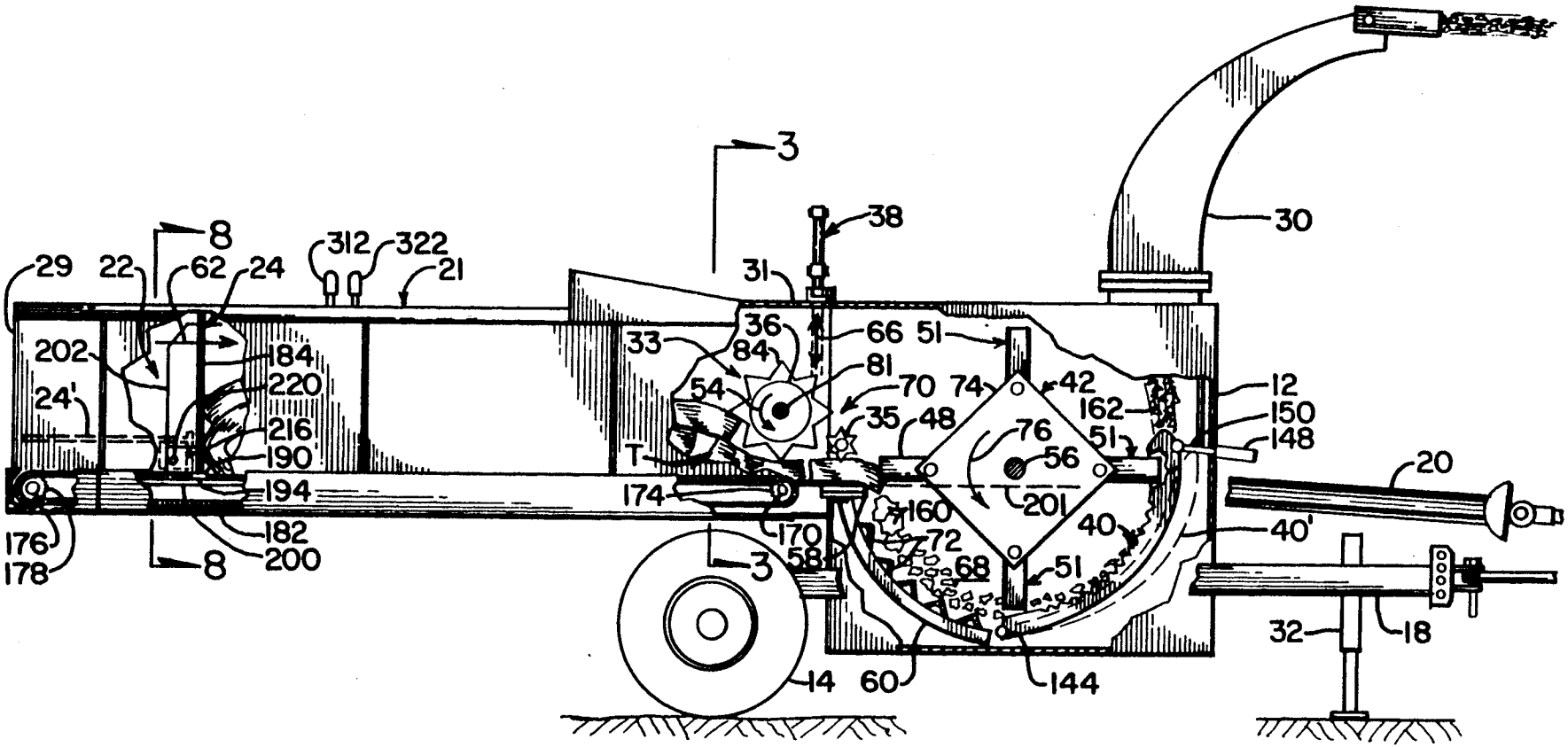
FIG. 2 is a side view in elevation of the hammer mill apparatus according to the present invention with portions of the main housing and horizontal feed chute broken away to show the cylindrical feed drum and metering roller, rotor assembly, concave grinding teeth, adjustable grinding ramps, and reciprocating feed plate.

The improved, light duty, reciprocal feed hammer mill 10 according to the present invention is illustrated in FIG. 1, and comprises a main housing 12 mounted on a pair of wheels 14, 16 with a drawbar 18 and power takeoff shaft 20 adapted for detachable connection to a conventional farm tractor (not shown). The power take-off shaft 20 is connected to drive a hammer mill rotor 42 (FIG. 2) via a 90° gear box 44 (FIG. 1) connected to a horizontal main rotor shaft 56 (FIG. 2). A conventional jack stand 32 can be provided to hold up the drawbar 18 when it is not hooked to a tractor. This reciprocal feed hammer mill 10 is particularly designed and adapted for use with small to moderate horsepower farm or industrial tractors, such as in the 50 to 100 horsepower range, and for use in grinding or comminuting a wide variety of materials, including tree branches, twigs, leaves, grass, plant matter, and other waste materials commonly resulting from commercial landscape operations, industrial wastes, such as lumber from construction sites, paper, and cardboard, and the like, as well as agricultural materials, such as grains, hay, straw, and other livestock feeds and bedding materials. Of course, the hammer mill 10 could also be stationary mounted and driven by a stationary engine or electric motor (not shown) instead of by a tractor power takeoff, as would be well within the capability of persons skilled in the art without departing from the scope of this invention.

To accommodate the varying homogeneity of the materials likely to be fed into the hammer mill 10 for comminuting, reciprocating feed apparatus 21, including a horizontal feed chute 22 and a reciprocating feed plate 24 is provided, along with metering apparatus 33 comprised of a large cylindrical feed drum 36 and smaller metering roller 35 (not shown in FIG. 1, but shown in FIGS. 2 and 3), and feed drum adjustment apparatus 38. The feed drum adjustment apparatus 38 allows the position of the feed drum 36 and metering roller 35 to be adjusted upwardly and downwardly without changing the downwardly directed spring bias, which allows the feed drum 36 and metering roller 35 to accommodate and meter feed selected amounts, depending on the type of material being comminuted, as will be described in more detail below. A plurality of hammer gangs 51 extending radially outward from the periphery of a grinding rotor assembly 42 (FIG. 2) tear at the material fed by feed drum 36 and metering roller 35 and pull it down into the grinding chamber 68 in main housing 12, where it is comminuted on a series of protrusions 72 commonly called concaves and on a grinding ramp assembly 40 before it is discharged in a comminuted condition out spout 30. An adjustable grinding ramp assembly 40 (FIG. 2) regulates the sizes of the comminuted fragments 162 discharged by the hammer mill 10.

In operation, a batch of branches, twigs, leaves, hay or straw bales, or other material to be comminuted (not shown) is loaded into the cavity 26 (FIG. 1) of feed chute 22 and is then gradually pushed in a controlled, but positive manner by feed plate 24 into the metering apparatus 33 (FIG. 2). The metering apparatus 33 then provides the function of metering the material into the grinding chamber 68 in main housing 12, where it is comminuted and ejected out of spout 30, as will be described in more detail below. The metering apparatus 33 at times pulls and at times holds back the material to be comminuted as it is fed into the grinding chamber 68, depending on the characteristics of the material. Initially, the material, of course, has to be pulled from the chute 22 by the metering apparatus 33 and pushed into the grinding chamber 68, which is sufficient feed action for some materials. For example, when a branch (not shown) is fed into the metering apparatus 33, the cylindrical feed drum 36 engages the branch and pulls it at a steady, controlled rate into the grinding chamber 68 in main housing 12 where it is systematically chopped or broken into manageable sized chunks of wood by the hammers 48 in gangs 51 on the rotor 42 spinning at a high velocity as indicated by arrow 76.

When fibrous material, such as a hay bale or straw bale is being comminuted, the teeth 84 on feed drum 36 tear and separate hay or straw from the bale and feed it uniformly into the grinding chamber 68. At the same time, the feed plate 24 steadily pushes the bale into the reach of the teeth 84, so the combination of the action of feed plate 24 with the metering apparatus 33 results in an even, steady feed of the hay or straw into the grinding chamber 68. The actions of feed roll 36 and feed plate 24 for bulk grass clippings, leaves, and the like are similar to those for hay bales or straw bales.

On the other hand, other materials, such as cardboard, waste paper, or telephone books, especially when somewhat damp, tend to get grabbed by the hammers 48 in gangs 51 and pulled in large wads or slugs into the grinding chamber 68. Such large wads or slugs of material would diminish the capability of the hammer mill 10 to operate properly or comminute the material to the desired particle sizes and uniformity, and, if large enough, could actually jam the rotor assembly 42 and prevent it from turning. In grinding such materials, the metering apparatus 33 actually tends to hold the material back, resisting the pull by the hammers 51, thus enhancing the ability of the hammers 51 to grab and tear the material presented to them and pull it into the grinding chamber 68 in smaller chunks and in a more uniform manner. For example, when waste paper, such as the used telephone books T illustrated in FIG. 2 are slowly pushed into the metering apparatus 33 by feed plate 24, the teeth 84 on the periphery of the large feed drum 36 tend to pull and separate individual books T from the pile and push them toward the grinding rotor 42. The hammers 48 of the grinding rotor 42 tend to grab and pull entire books T into the grinding chamber 68, which, if allowed to occur, would inhibit effective comminution of the books T. However, the small metering roller 35 positioned essentially over the ledger plate 58 between the larger feed drum 36 and the grinding rotor 42 turns at a predetermined rate of speed that holds the telephone book T back and prevents it from being pulled too fast by the hammers 48 into the grinding chamber 68. Consequently, the hammers 48 are allowed to be more effective in tearing the books T into chunks 160 over the ledger plate 58, which chunks can then be comminuted effectively in grinding chamber 68 into a desired uniformly-sized comminuted material 162 for discharge out spout 30.

For larger or longer items, the large feed drum 36 can also serve to hold such items back and from being pulled too soon into grinding chamber 68 by hammers 48. However, for smaller or shorter items, like the telephone books T described above, the items are no longer in contact with the teeth 84 on feed drum 36 when the hammers 48 grab them, and the large diameter of the feed drum 36 limits how close it can be positioned to the grinding rotor 42 without interfering with the hammers 48. At the same time, making the feed drum 36 smaller would inhibit its effectiveness at grabbing and metering other materials such as hay, leaves, and the like from bales or bulk piles being pushed into it by feed plate 24, as described above. Therefore, the smaller metering roller 35 between the feed drum 36 and grinding rotor 42 allows retention of the advantages of the larger diameter feed roller 36 while eliminating the disadvantages, as described above.

As also indicated above, while the metering apparatus 33 is capable of pulling and feeding the material to be comminuted in a uniform manner into the main housing 12, once the material contacts the metering apparatus 33, bulk materials, such as twigs, leaves, yard clippings, hay, or straw must be continually urged along or pushed into contact with the metering apparatus 33; otherwise, the metering apparatus 33 becomes ineffective. Therefore, reciprocating feed apparatus 21, including the feed plate 24 slidably positioned in chute 22, is provided according to this invention to push the material to be comminuted into the metering apparatus 33.

The components and structure of both the metering apparatus 33 and the reciprocal feed apparatus 21 will be described in more detail below. However, it is appropriate to mention here that the feed plate 24 is driven in one direction to push a batch of material in chute 22 toward the metering apparatus 33 and then is retracted to the distal end 29 of chute 22 so that another batch of material to be comminuted can be loaded into the chute 22, as will also be described in more detail below. Thus, the feed of material according to this invention is in principle a batch feed process, although each batch is fed in a very uniform manner into the grinding chamber 68.

The size of the feed plate 24 is preferably large enough to substantially fill a cross-sectional plane through the chute 22, so that it contacts and substantially positively pushes all material in the chute 22 into the metering apparatus 33, which is more effective for a wide-ranging variety of materials to be comminuted than many continuous feed apparatus, such as chain conveyors, augers, rotating tubs, and the like. The reciprocal feed plate 24 can also eliminate any need for hand-feeding or manual pushing of materials, such as branches, bales, cardboard sheets, and the like, into the metering apparatus 33, thus keeping the user or operator further away from the more dangerous components, including the feed drum 36 and hammers 48. However, if it is desired to hand feed long boards, branches, or the like, the feed plate 24 is foldable into a lowered position, as shown in broken lines 24' in FIG. 2 and as will be described in more detail below.

Of course, it is desirable for the most efficient and effective feed to coordinate the linear speed of the feed plate 24 as it pushes material into the metering apparatus 33 with the rotational speed of the feed drum 36 such that the feed plate 24 is not so fast as to force-feed the material into feed drum 36 faster than feed drum 36 can handle it, yet fast enough to maintain the material constantly within reach of the teeth 84 on feed drum 36. In this manner, the feed plate 24 and metering apparatus 33 work together, along with the metering roller 35 as described above, to provide a uniform, metered feed of material to be comminuted into the grinding chamber 68, regardless of the character or kind of material.

In the preferred embodiment, the reciprocating action miller 10 of the present invention is relatively small in size, with the cavity 26 in feed chute 22 being sized to hold approximately two conventional-sized square bales of hay when the feed plate 24 is fully retracted to the distal end 29 of feed chute 22, as seen in FIG. 1. For example, most conventional square bales have a transverse cross section of about 16 in. (406 cm.)×18 in (457 cm.), and a longitudinal length of about 36 in. (914 cm.). Therefore, the cavity 26 of feed chute 22 is preferably about 17 in. (432 cm.) wide and 19 in. (229 cm.) deep, and it is preferably long enough to allow the feed plate 24 to be retracted at least about 84 in. (2134 cm.) from the feed drum 36. This length is also appropriate to accommodate batch dumping of materials into the chute 22 by small to medium-sized front end loaders, as will be described in more detail below.

Since the feed chute 22 and metering apparatus 33 are positioned to feed material into the path of the hammers 51 from a direction almost radial to the rotor assembly 42, the rotor assembly 42 is also preferably about as wide as a conventional square bale, or about 16 in. (406 cm.) wide, and each gang of hammers 51 preferably cuts a path about 15 in. (381 cm.) wide as the rotor assembly 42 rotates. Therefore, the feed of a conventional square bale into the grinding chamber 58 by feed chute 22 and metering apparatus 33 is essentially directly into a comparable width grinding chamber 68 and into the path of comparable width hammer gangs 51 without passing through any transverse width restrictions.

This overall size of the hammer mill 10 of the preferred embodiment not only accommodates square bales, as described, above, but also enhances its ability to comminute relatively tough materials, including yard waste and even branches and tree trunks up to diameters in the range of 4 to 5 inches, as well as its ability to handle occasional chunks of non-comminutable material, such as metal, rock, or concrete without damage. Moreover, the size of the machine 10 increases material throughput such that it can quickly comminute larger amounts of refuse commonly produced by landscape operations, which is the environment for which it was designed. As mentioned above, the reciprocating feed apparatus 21 enhances the feed operation and efficiency of the hammer mill 10, simplifies construction, and reduces cost by dispensing with the need for large, complex, and cumbersome rotating tubs or other specialized conveyors and feed apparatus. Finally the adjustable, jam-resistant metering assembly 33, replaceable and adjustable ledger plate 58, and the adjustable grinding ramp assembly 40 are easily adjustable to regulate the feed rate as well as the finished sizes of the comminuted fragments discharged by the hammer mill while also passing occasional chunks of non-comminutable material without damage to the hammer mill.

Figure 8:
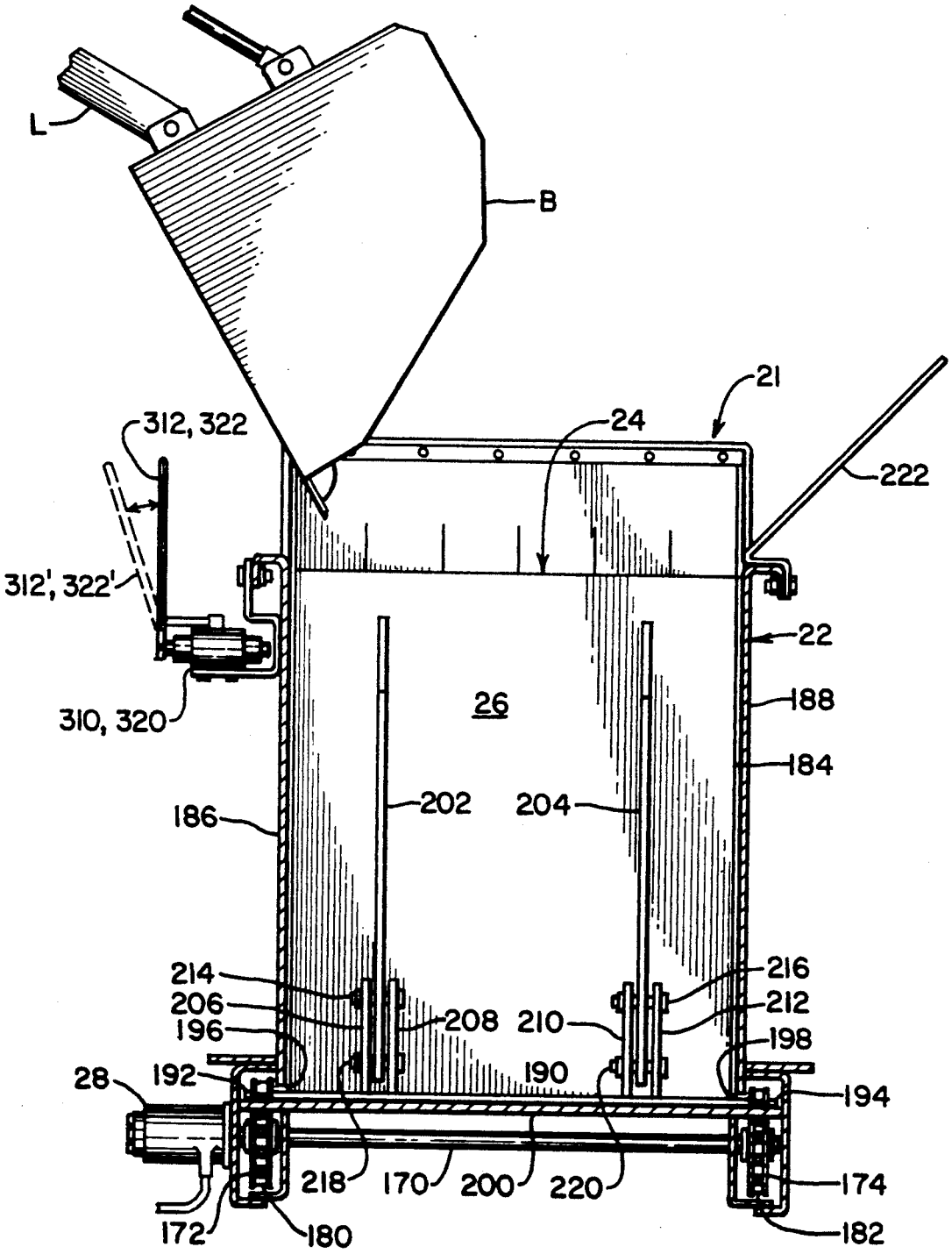
FIG. 8 is a cross-sectional view of the reciprocal feed apparatus of the present invention taken along line 8—8 of FIG. 2.

Referring now to FIGS. 1 and 2 in combination with FIG. 8, the reciprocal feed apparatus, as mentioned above, is designed to receive batch dumps of material to be comminuted, for example, from a bucket B on a conventional small to medium-sized front end loader L. A batch of material to be comminuted, such as, for example, the used telephone books T illustrated in FIG. 2, are preferably dumped into the cavity 26 of feed chute 22 with the feed plate 24 positioned near the distal end 29. The feed plate 24 is then moved forward at a predetermined rate, as indicated by arrow 62 to push the material to be comminuted into the metering apparatus 33, as described above. When the feed plate 24 is advanced to a position near the feed apparatus 33, thereby having pushed nearly the entire batch of material to be comminuted into the metering apparatus 33, it stops and then reverses direction to return to its starting position near the distal end 29, so the chute 22 is ready to receive another batch of material to be comminuted.

The feed plate 24 is preferably driven forward and back in chute 22, as described above, by a hydraulic motor 28, although other appropriate drive apparatus, such as a hydraulic cylinder, electric motor, or gear drive (not shown) could also be used. The hydraulic motor 28 is connected to a drive shaft 170, which extends transversely under the proximal end 31 of chute 22, and a pair of drive sprockets 172, 174 are keyed to opposite ends of the shaft 170. A pair of idler sprockets 178 are also mounted on idler bolts 176. Please note that only one of the sprockets 178 and bolts 176 can be seen on one side of the feeder 21 in FIG. 2, but there is a similar sprocket 178 and bolt 176 on the other side as will be understood by persons skilled in this art. A pair of roller chains 180, 182 extend between the respective drive sprockets 172, 173 to the idler sprockets 178 along the lower outside edges of chute 22. The feed plate 24 is attached to the roller chains 180, 182, as will be described in more detail below, so that the hydraulic motor 28 pulls the feed plate 24 forwardly and backwardly in chute 22 via the drive sprockets 172, 173 and roller chains 180, 182. The hydraulic control circuit for controlling the forward and backward movement of the feed plate 24 in chute 22 will be described below.

Referring to FIG. 8 in combination with FIGS. 1 and 2, the feed plate 24 is preferably comprised of a vertical plate 184 that essentially spans the width and depth of cavity 26 in chute 22. The cavity 26 is defined by first and second side wall panels 186, 188 extending upwardly from near a floor panel 200. The bottom edge of the vertical plate 184 abuts on and extends upwardly from a flat, horizontal support plate 190 that is slidably positioned on the floor panel 200, as best seen in FIG. 8. The lateral ends 192, 193 of support plate 190 extend through respective narrow slots 196, 198 between wall panels 186, 188 and floor panel 200. The upper sections of roller chains 180, 182 are attached to respective lateral ends 192, 193 of support plate 190. Therefore, forward and rearward movement of those upper sections of roller chains 180, 182 pull the support plate 190, thus the entire feed plate 24, forwardly and rearwardly in chute 22. The roller chains 180, 182, being positioned adjacent the slots 192, 198 between wall panels 186, 188 and floor panel 200 also effectively keep materials to be comminuted placed in chute 22 from escaping through slots 192, 198, which is important when the material to be comminuted comprises grains and other materials having small particle sizes. Therefore, this feature enhances the universality of the grinder 10 in handling a wide variety of materials to be comminuted. A side panel extension 222 can be mounted on the top edge of side panel 188, as shown in FIG. 8, to better confine material being dumped by bucket B into chute 22.

The vertical plate 184 of feed plate 24 is foldably attached to the support plate 190, so that it can fold down into the horizontal position illustrated by broken lines 24' in FIG. 2. A pair of back braces 202, 204, are affixed to and extend vertically along the rear surface of vertical plate 184. The lower end of one brace 202 is positioned between two ears 206, 208, which are affixed to support plate 190, and the lower end of the other brace 204 is similarly positioned between two ears 210, 212, which are also affixed to support plate 190, as best seen in FIG. 8. A pivot pin 218 pivotally connects brace 202 to ears 206, 208, and pivot pin 220 pivotally connects brace 204 to ears 210, 212. Anchor pins 214, 216 also connect respective braces 202, 204 to ears 206, and 208 and 210, 212. When anchor pins 214, 216 are removed, the vertical plate 184 can pivot about pivot pins 218, 220 to the horizontal position 24' shown in FIG. 2. This folded down position, as already mentioned above, allows a user to hand-feed long boards or branches through the chute 22 into metering apparatus 33, which also enhances the universality of the hammer mill apparatus 10 according to this invention for handling a wide variety of materials.

Referring again primarily to FIG. 2, the material to be comminuted or raw feed product T is pushed against feed drum 36 by feed plate 24 as it advances in the direction indicated by arrow 62, which, along with metering roller 35, meters and feeds the material T into grinding chamber 68 through opening 70. The feed drum 36 has a plurality of teeth 84 around its periphery, preferably in the form of a plurality of plates 85 affixed in spaced apart relation to each other on the surface of drum 36. The teeth 84 are pointed projections on the plates 85. Similar teeth are provided on metering roller 35.

Feed drum 36 and its shaft 81 (FIG. 3) are preferably mounted on adjustment apparatus 38 in such a manner that the feed drum 36 and metering roller 35 not only rotate under the power of a suitable drive mechanism, such as a hydraulic motor 46, in the direction of arrow 54, but also so that it can move upwardly and downwardly, as indicated by arrow 66 (FIG. 2), as will be described in detail below. Such vertical movement of feed drum 36 and metering roller 35 accommodates the feeding of various sized solid materials, such as branches or tree limbs, into the hammer mill, while still maintaining engagement with such branches, limbs, or other materials of all sizes being fed therein. The hammer gangs 51, comprising a plurality of individual hammers 48, of rotor assembly 42 engage the incoming material T being fed by drum 36 and tear or force it over ledger plate 58, thereby breaking the material T into chunks 160 and pulling them into the lower curved portion of grinding chamber 68. Please note that, as illustrated in FIG. 2, the floor 200 of feed chute 22 is preferably positioned so that an extension 201 of the plane of the floor panel 200 passes slightly below the rotor shaft 56. Therefore, objects such as telephone books T, positioned on the floor panel 200 and ledger plate 58, have their bulk slightly above the plane of floor 200. Consequently, such objects T are struck by the hammers 51 at closer to 90 degrees than if floor 200 was aligned with rotor shaft 56. In the lower curved portion of grinding chamber 68, the chunks of material 160 are further ground across a series of teeth 72 protruding upwardly from a fixed grinding stator 60, thereby creating additional physical grinding and turbulence in the flow of material 160 through the grinding chamber 68.

An adjustable grinding ramp assembly 40, positioned downstream of fixed grinding stator 60, protrudes into the bottom portion of the grinding chamber 68 for additional final breaking and tearing of the material 160 to substantially complete the comminuting process. When the adjustable grinding ramp assembly 40 is positioned as shown in solid lines in FIG. 2, the individual hammers 48 in each hammer gang 51 pass through spaces between the grinding ramps to comminute the material 160 into small particles, as will be described in more detail below. Conversely, when the ramp assembly 40 is in the position 40', shown in broken lines in FIG. 2, the hammers 48 do not pass between the spaces of the ramp assembly 40, consequently producing particles of larger sizes. Therefore, this variable positioning of grinding ramp assembly 40 provides a means to readily and easily control the sizes of the comminuted particles from fine to coarse, depending on the position of the ramps. At the same time, the concavely curved ramps assist in guiding uncomminutable chunks of rock, steel, or the like toward the outlet 30, while avoiding damage.

It is preferred that the ledger plate 58 also be adjustable toward and away from the rotor 42. For many materials, positioning the ledger plate 58 closer to rotor 42 results in a finer initial comminution to smaller particles 160. However, such a closer setting also requires more power. Therefore, when grinding harder dense materials, such as compacted cardboard, it may be more beneficial to set the ledger plate 58 farther from the rotor 42, thereby getting larger initial chunks of material 160, but reducing horsepower requirements to an optimum.

Figure 3:
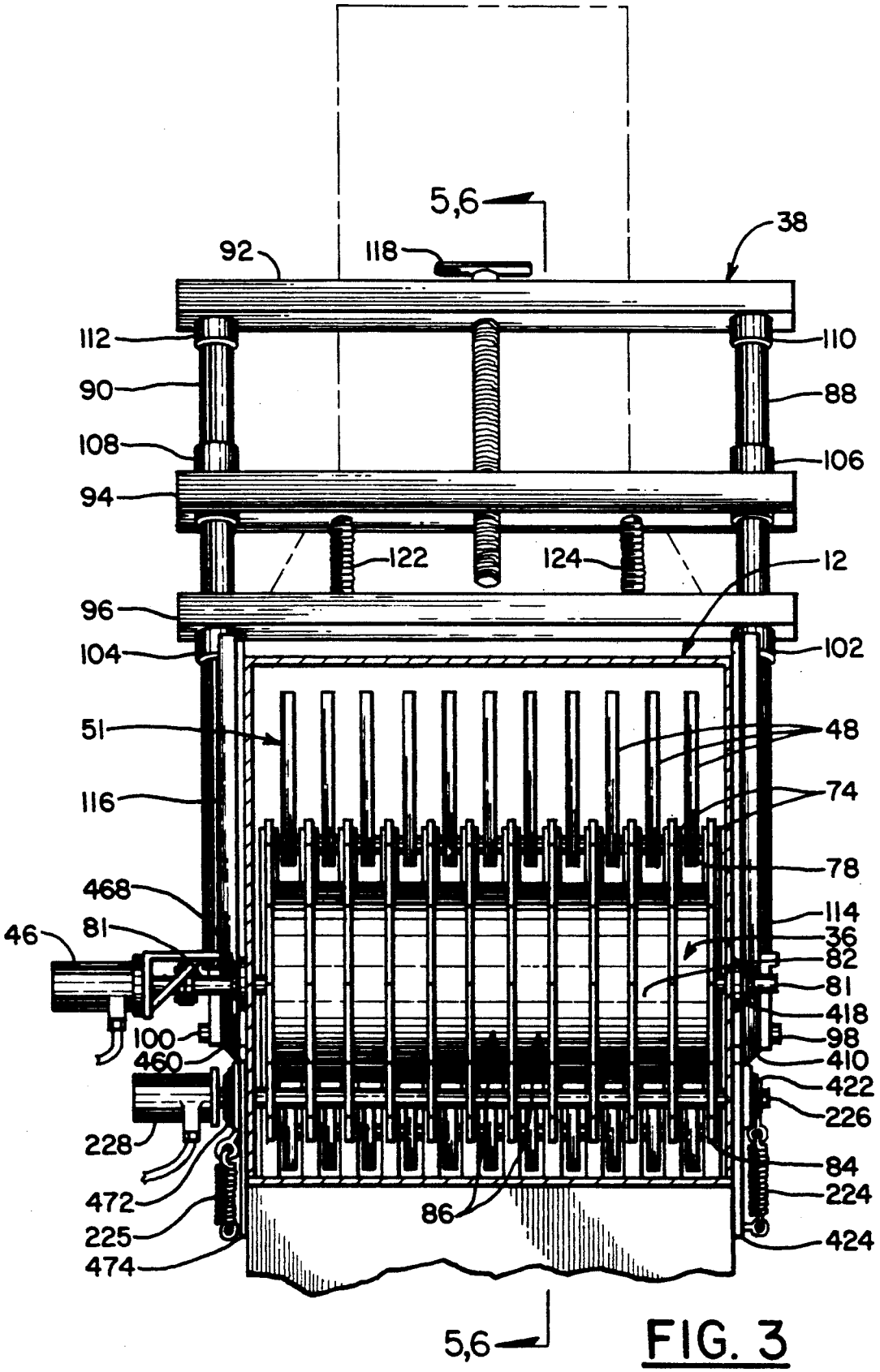
FIG. 3 is a cross-section view in elevation taken along the line 3—3 of FIG. 2, showing the cylindrical feed drum, some of the hammers on the rotor, and the adjustable, biased mounting for the cylindrical feed drum and metering roller.
Figure 4:
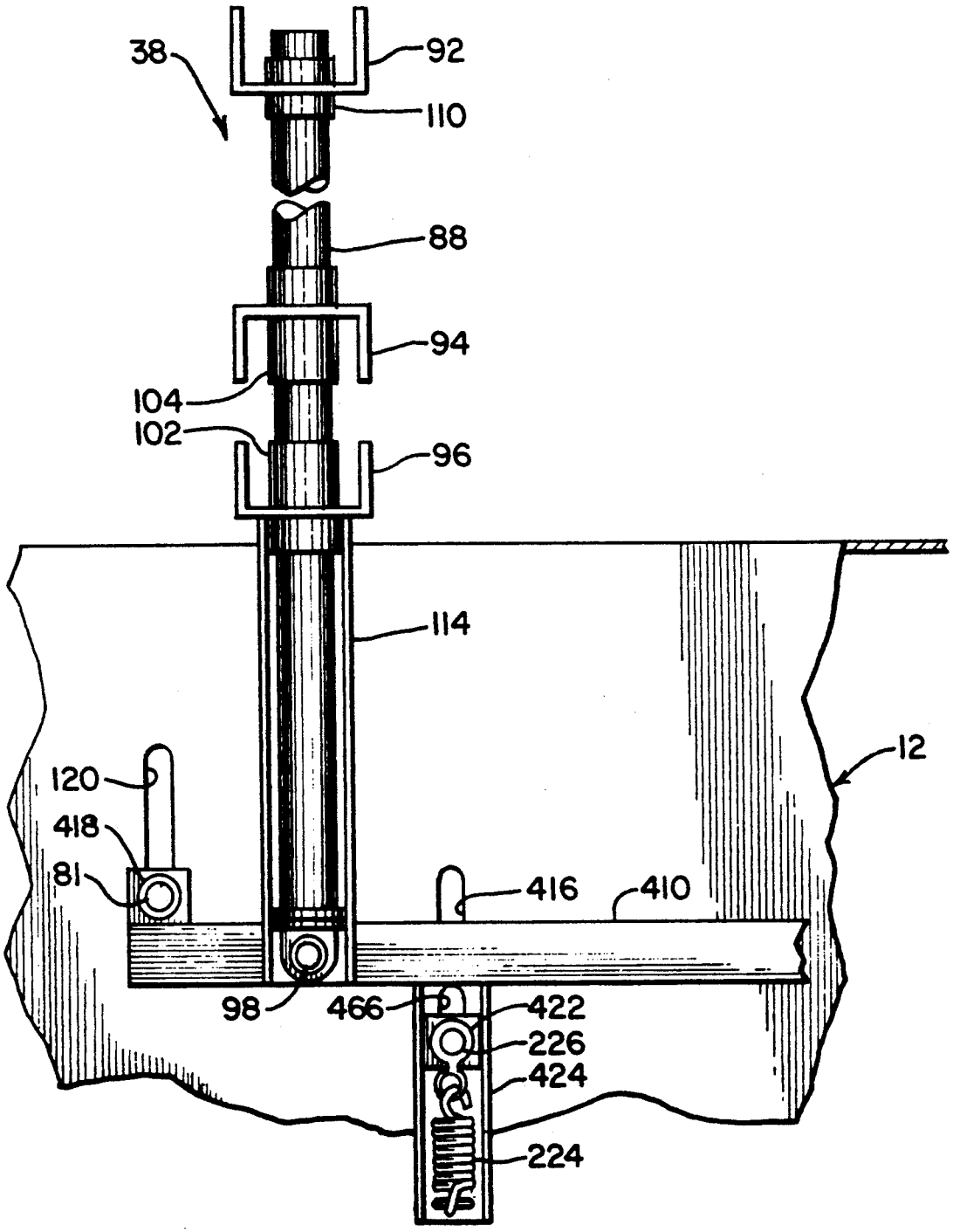
FIG. 4 is a right side view in elevation of the adjustable, biased mounting for the cylindrical feed drum and metering roller.

The hammer mill rotor assembly 42 and the feed drum assembly 36 are best described by referring to FIG. 3 along with FIG. 2. Essentially, the rotor assembly 42 is comprised of a plurality of hammer gangs 51 pivotally mounted between a plurality of spaced-apart rotor plates 74. These rotor plates 74 are mounted on main rotor shaft 56 (FIG. 2), which is journaled at each end in bearing blocks (not shown) attached to main housing 12. Main shaft 56 is driven by the power take-off 20 and gear box 44 in the direction indicated by arrow 76. The hammer gangs 51 are comprised of a plurality of elongated hammers 48 mounted on a large bolt or pin 78 that extends through the rotor plates 74. While this invention is illustrated with eleven (11) hammers 48 for each hammer gang 51 and four (4) hammer gangs 51 on the rotor assembly 42, either more or fewer hammer gangs 51, having more or fewer individual hammers 48 could be used, so long as the hammer gangs 51 are evenly spaced around the rotor 42 to maintain dynamic balance.

The cylindrical feed drum 36 enhances the control and metering of material into the hammer mill chamber 68 at a rate that can be handled by the hammer mill rotor assembly 42 with a relatively small horsepower tractor or engine attached thereto. The cylindrical feed drum 36 and metering roller 35 are adjustable upwardly and downwardly in relation to the opening 70 to control the amount and sizes of the material entering grinding chamber 68, while maintaining a relatively constant downward bias for positive engagement with the material T being fed into the metering apparatus 33.

Referring primarily to FIG. 3, the cylindrical feed drum 36 comprises a cylindrical rotor 82 mounted on drum shaft 81 that is connected to an appropriate drive apparatus, such as hydraulic motor 46. A plurality of drum teeth 84 extend radially outward from rotor 82 and are separated by spaces 86. The location of feed drum 36 within opening 70 also tends to inhibit pieces of wood or other material being carried by the hammers 48 all the way around the grinding chamber 68 from being thrown in a reverse direction back out through opening 70. A flexible curtain 19, as best seen in FIG. 1, is also positioned to hang over opening 70, as best seen in FIG. 1, to prevent particles of comminuted material from being thrown out the opening 70 by the hammer mill rotor 42 (FIG. 2).

The vertical position of feed drum 36 and metering roller 35 in the opening 70 can be adjusted upwardly and downwardly by adjustment apparatus 38 while still retaining a constant downward bias, as mentioned above. When the feed drum 36 is in the position shown in FIG. 2, only relatively small chunks of material T will be fed into the grinding chamber 68, which position would be desired when comminuting relatively dense material, such as paper and cardboard. However, when the feed drum 36 is raised, as indicated by arrow 66 in FIG. 2, a larger amount of material T and larger chunks of material T can be fed into the grinding chamber 68. This adjustable position of feed drum 36, therefore, allows the hammer mill 10 according to this invention to readily and efficiently handle a wide range and variety of different kinds and sizes of materials.

The feed drum adjustment apparatus 38 is best described by referring to FIGS. 1, 2, 3, 4, 5, and 6 simultaneously. Essentially, referring initially to FIG. 1, the adjustment apparatus 38 comprises a pivotal mounting arm 410 to which the feed drum shaft 81 and preferably also the metering roller shaft 226 are mounted. The pivotal mounting arm 410 is preferably pivotally mounted at one end to the main housing 12, such as on pivot pin 412, such that it is moveable upwardly and downwardly about pivot pin 412, as indicated by arrow 414 in FIG. 1. A similar pivotal mounting arm 460 is positioned on the opposite side of main housing 12, as shown in FIG. 3. The feeder drum shaft 81, which extends through slotted holes 120 in both sides of housing 12 (see FIG. 1 for one side only), is journaled in bearings 418, 468 mounted on pivotal arms 410, 460, respectively. Therefore, as the pivotal arms 410, 460 pivot upwardly and downwardly, as shown by arrow 414 in FIG. 1, the feed drum 36 moves upwardly and downwardly.

Two guide tubes 88, 90 are held in parallel spaced-apart relation by upper, middle, and lower cross members 92, 94, and 96, respectively. The pivotal arms 410, 460 are pivotally connected to the lower ends of guide tubes 88 and 90 by pins 98, 100, respectively, as shown in FIGS. 1 and 3. Guide tubes 88, 90 slide through sleeves 102, 104, 106, and 108 of lower and middle cross members 96, 94, and are fixed to sleeves 110, 112 attached to upper cross member 92, such that upper cross member 92 moves with guide tubes 88, 90. Lower cross member 96 is attached to main housing 12 by channel guides 114, 116.

The position of feed drum 36 within opening 70 can be adjusted upwardly and downwardly by turning jack screw 118, which changes the position of upper cross member 92 in relation to middle and lower cross members 94, 96. Since guide tubes 88 and 90 are connected to upper cross member 92 by sleeves 110 and 112, moving the upper cross member 92 causes a similar movement of pivotal arms 410, 460, thus also of feed drum 36.

Figure 5:
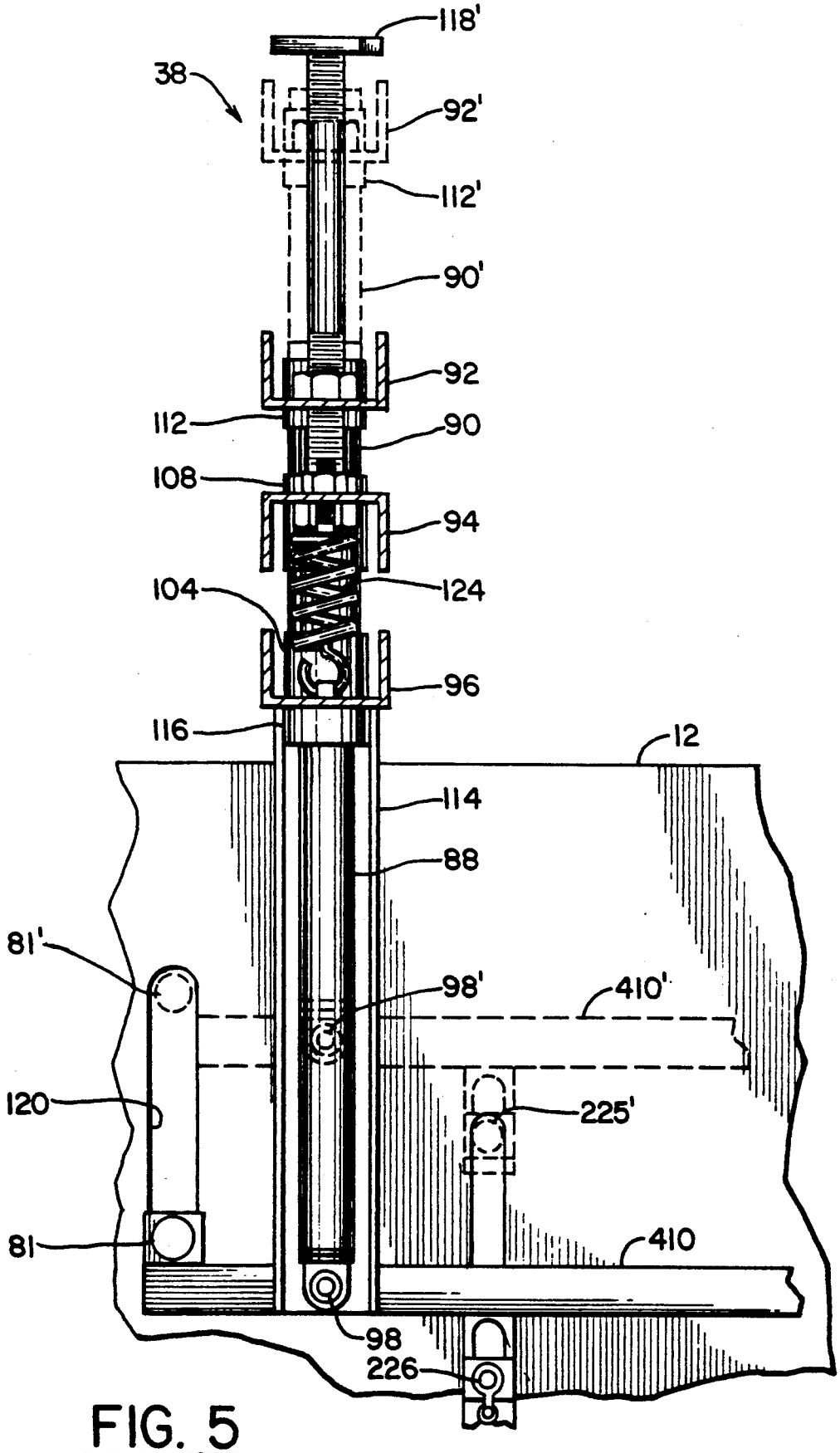
FIG. 5 is a cross-section view in elevation taken along the line 5—5 of FIG. 3, showing in solid lines the position of the upper cross member of the adjustable biased mounting when the cylindrical feed drum and metering roller are in their lowest positions and showing in broken lines the position of the upper cross member when the cylindrical feed drum and metering roller are adjusted to their highest positions.

Referring now to FIGS. 2 and 5 simultaneously, when the feed drum 36 is in the position shown in FIG. 2, the upper cross member 92 is in the position shown in solid lines in FIG. 5, as is shaft 81 within slot 120. To adjust the position of the feed drum 36 to the position 36' indicated in FIG. 5, the jack screw 118 is turned, moving upper cross member to position 92', pivotal arm 410 to the position 410', and drum shaft 81 to position 81'. Thus, the position of the feed drum 36 can be varied upwardly and downwardly by simply turning jack screw 118.

Figure 6:
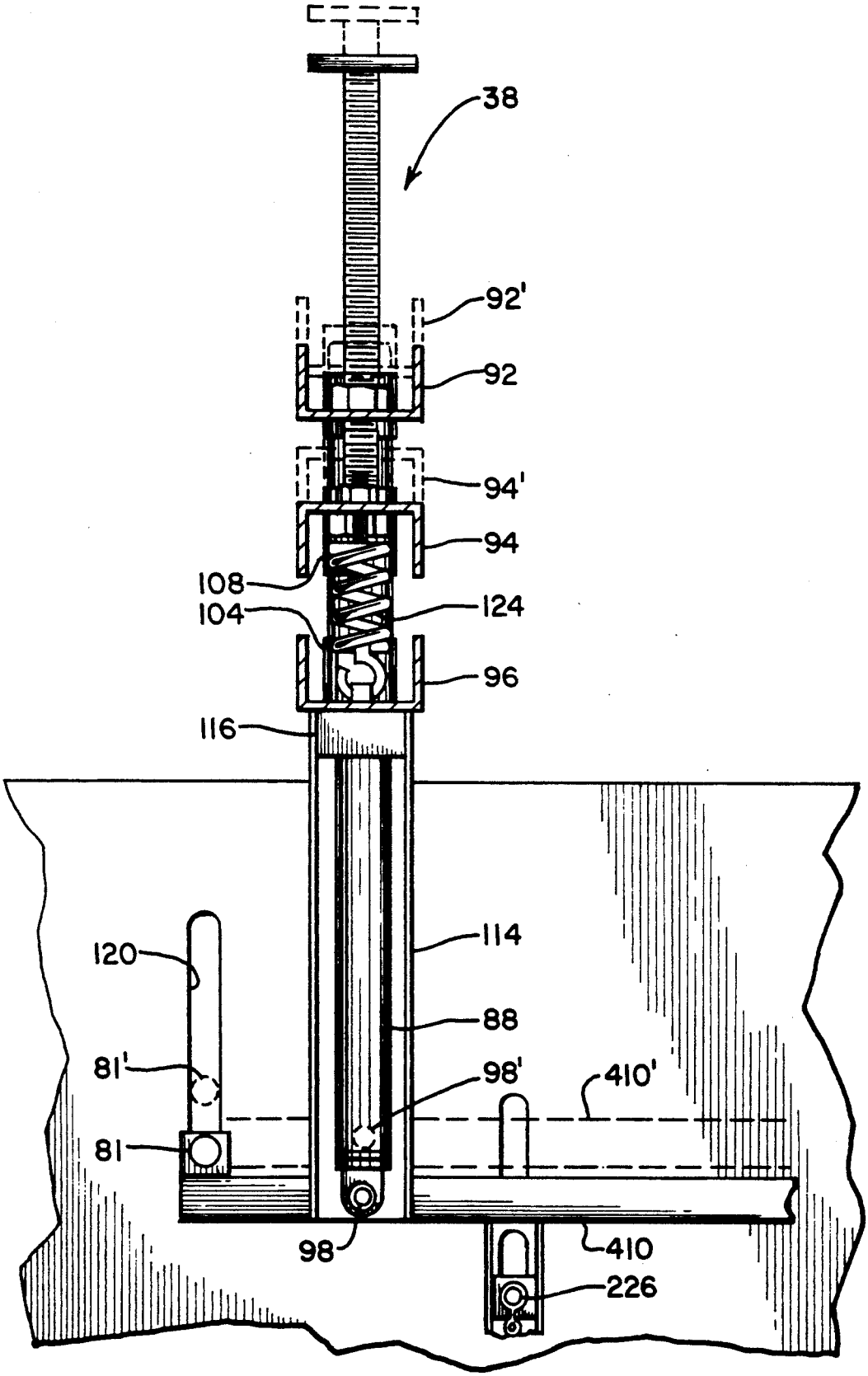
FIG. 6 is a cross-section view in elevation taken along the line 6—6 of FIG. 3, showing in solid lines the position of the middle and upper cross members of the adjustable biased mounting during a normal feed operation and showing in broken lines the positions of the middle and upper cross members when the cylindrical feed drum and metering roller are displaced upward against the bias spring.

The engagement of the teeth 84 of feed drum 36 with the incoming material is further enhanced and maintained by a spring bias that provides a constant, strong, downwardly directed force on the shaft 81 of drum 36, regardless of the vertically adjusted position setting described above. This downward bias is provided by a pair of coiled tension springs 122, 124 (FIG. 3). The coil springs 122, 124, are anchored at one end to lower cross member 96, with their other ends connected to middle cross member 94. Since the middle cross member 94 is connected to upper cross member 92 by jack screw 118, the springs 122, 124 will always apply the same strong, downward force on the pivotal arm 410, thus on feed drum 36 regardless of the position of the drum 36. This downward bias yields to the various thicknesses of the comminutable material being feed into the drum 36 by feed plate 24 and under drum 36 into the milling chamber 68. The spring bias will also allow drum 36 to yield when encountering non-comminutable material, thereby passing small pieces of the non-comminutable material instead of jamming the feed drum 36. Referring to FIG. 6, the bias springs 122, 124 will allow the middle cross member to move to position 94' and the upper cross member to move to position 92', with a corresponding movement of pivotal arm 410 to position 410' and drum shaft 81 to position 81', as indicated by broken lines.

The metering roller 35 is also preferably on a downward bias to enhance its engagement with material T passing through opening 70 into grinding chamber 68. Such a downward bias on metering roller 35 can also be provided by the adjustable position, constant bias apparatus 38 described above for the feed drum 36 by mounting the shaft 226 of metering roller 35 on the pivotal arm 410. The metering roller shaft 226 extends through a pair of slotted holes 416 in opposite sides of housing 12, where it is journaled in a bearings 422, 472, which are slidably mounted in respective elongated brackets 424, 474 on opposite sides of housing 12. The elongated brackets 424, 474 are affixed to the pivotal arms 410, 460, respectively, and extend downwardly therefrom to the position of the metering roller shaft 226. Each elongated bracket 424, 474 has a slotted hole 466 that is aligned with slotted holes 426 in housing 12 to accommodate extension of the metering roller shaft 225 through the elongated brackets 424, 474 and into the slidably mounted bearings 422, 472. Consequently, the metering roller shaft 226 can move up and down along with pivotal arms 420, 460 as they are moved up and down by the biased adjustment apparatus 38 or by the feeder drum 36 riding over material in the chute 22, as described above. In that upward and downward movement, the metering shaft 226 moves upwardly and downwardly in slotted holes 416 in housing 12.

At the same time, it is important that the metering roller 35 not be confined to move up and down absolutely in conjunction with the feed drum 36, because it could lose its ability to function in its metering role of engaging and holding back objects, such as the telephone books T illustrated in FIG. 2 and as described above, after the feed drum 36 is no longer in contact with the object T. Therefore, it is preferred that, while the position of the metering roller 35 is adjustable upwardly and downwardly with the adjusting apparatus 38 along with the feed drum 36 to accommodate various materials with different characteristics, it is also preferred that it retain some ability to move independently as well. Consequently, the bearings 422, 472 in which the ends of metering roller shaft 226 are journaled are mounted slidably in elongated brackets 424, 474, and the brackets 424, 474 also have slotted holes 466, as described above, to accommodate upward and downward movement of metering roller shaft 226 in relation to pivotal arms 410, 460. The metering roller shaft 226 is also biased downwardly by springs 224, 225 connected to the respective metering shaft bearings 422, 472 and anchored to the lower ends of the respective elongated brackets 424, 474.

With this arrangement, if the feed drum 36 rides up and over a larger object in chute 22, the springs 224, 225 bias the metering roller 35 to remain in engagement with other objects that it is metering into the grinding chamber 68. Likewise, if a large object passes under metering roller 35, it will not necessarily hold feed drum 36 up when it would otherwise be down.

Of course, there are other alternatives of this invention to the specific structure described above. For example, the biased adjustment apparatus 38 could be connected only to the feed drum shaft 81 and a separate but similar biased adjustment apparatus could be provided for the metering roller shaft 226, or the metering roller shaft could just be spring anchored to the housing 12 with no appreciable adjustment or variation in the bias strength or shaft position. Also, if the feed drum 36 is heavy enough and depending on the nature of the material being handled, the bias springs 122, 124 in adjustment apparatus 38 might not even be necessary. However, the adjustment apparatus 38 described above has several advantages. In addition to the upward and downward adjustment without adversely affecting the bias strength as described above, the combination of the substantially horizontal pivotal arms 410, 460 with the guide tubes 88, 90 and channel guides 114, 116 tend to stabilize the orientations of drum shaft 81 and metering roller shaft 226 so that they do not get cocked in the housing 12 and possibly jammed by an uneven distribution of material under them. For example, if a large chunk of material gets pulled under one side or end of the feed drum 36 with nothing of comparable size under the opposite end, the adjustment apparatus tends to keep both ends moving upwardly and downwardly in unison, rather than letting the large chunk lift one end while the other end remains down.

A hydraulic motor 228 is shown in FIG. 3 attached to metering roller shaft 226 for driving metering roller 35 and a separate hydraulic motor 46 is shown attached to feed drum shaft 81 for driving feed drum 36, although other kinds of drives could also be used. For example, only one of the hydraulic motors 46 or 228 could be used in combination with a roller chain or other similar drive (not shown) connecting feed drum shaft 81 with metering roller shaft 226. Other mechanical, electric, or appropriate drives could also be used. In this regard, it is preferred, although not necessary, that the metering roller 35 be driven with an angular velocity that produces a linear peripheral surface speed that is slightly greater than the linear peripheral surface speed of the feed drum 36.

Figure 7:
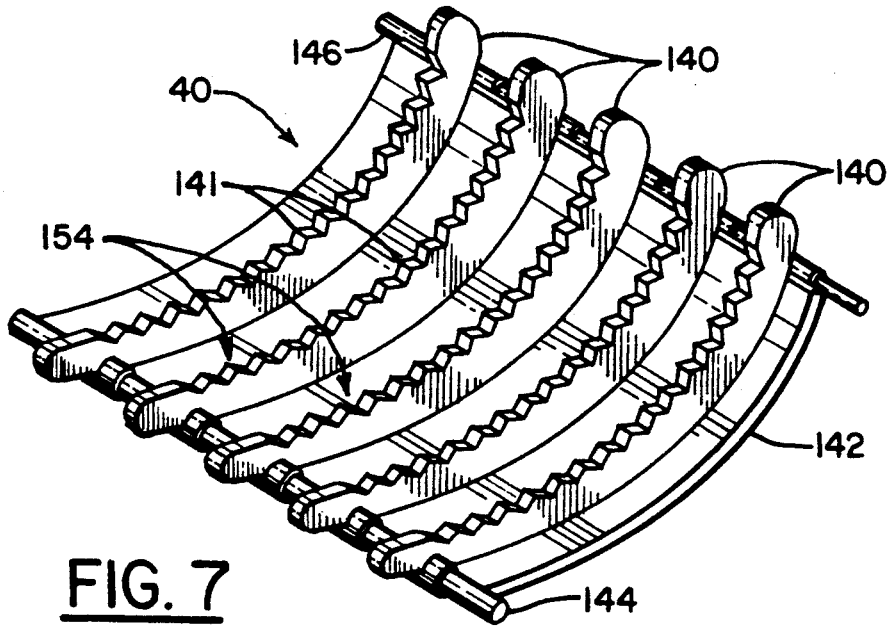
FIG. 7 is a perspective view of the adjustable grinding ramps, showing the spacing between the ramps through which the hammers can pass as they are rotated by the rotor.

Referring back to FIG. 2, after the material is fed into grinding chamber 68, it is torn and broken apart by the action of the hammers 48, ledger plate 58, stationary grinding stator 60, and adjustable ramped grinding teeth assembly 40. Referring now to FIGS. 2 and 7 simultaneously, the ramped grinding teeth assembly 40 comprises a series of elongated, curved grinding teeth 140 attached to curved backing plate 142 in spaced apart relation to each other, such that the spaces 154 between the teeth 140 are wide enough to allow the hammers 48 to pass therethrough as rotor assembly 42 rotates. A lower pivot shaft 144 journaled in main housing 12 allows ramped grinding teeth assembly 40 to pivot as shown in FIG. 2. An upper shaft 146 is mounted to a suitable adjustment apparatus 148, such as a hydraulic or pneumatic cylinder, via strut 150. The adjustment apparatus 148 allows the ramped grinding teeth assembly to be selectively positioned between positions 40 and 40' in FIG. 2, thereby allowing the user to conveniently select the sizes of the comminuted particles that will result from the comminuting process. When the ramped grinding teeth assembly is in position 40 shown in FIG. 2, the sizes of the particles will be small. Conversely, when the ramp assembly is in position 40', the particles will be larger. The upper surfaces 141 of the elongated, curved teeth 140 are preferably serrated, as illustrated in FIGS. 2 and 7, to enhance further turbulence and comminution of the material being ground. Finally, the curved shape of the ramped tooth assembly 40 allows occasional chunks of non-comminutable material to be swept out the spout 30 by the hammers 48 to prevent damage or jamming of the hammer mill.

Figure 9:
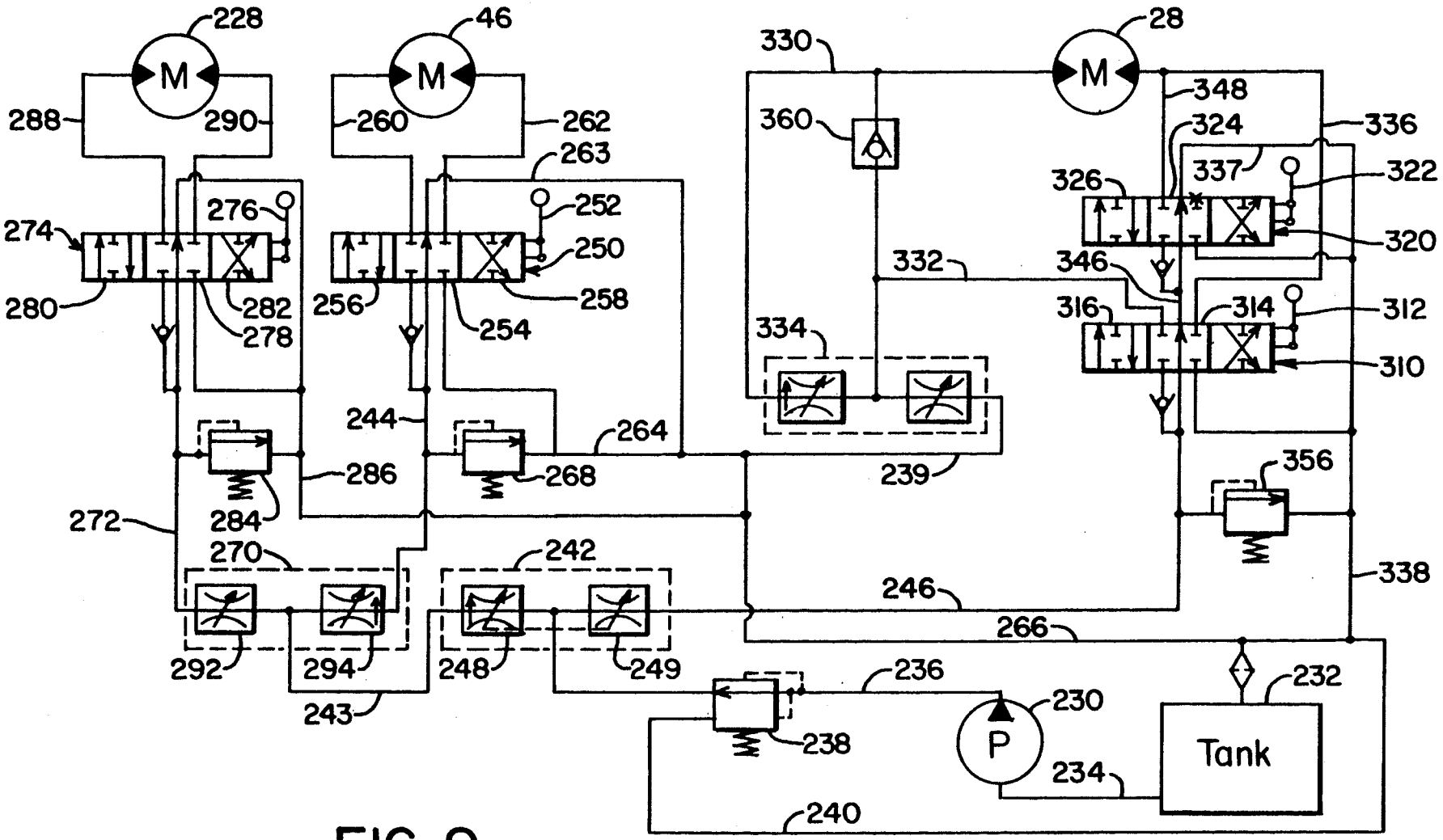
FIG. 9 is a schematic diagram of the hydraulic circuit and controls of the present invention.

A suitable hydraulic control circuit and components for the reciprocal feed apparatus 21, feed drum 36, and metering roller 35 is shown in FIG. 9. Essentially, a hydraulic pressure pump 230, which can be connected to rotor shaft 56 or any other suitable drive, draws hydraulic fluid from a reservoir or tank 232 through suction line 234 and discharges it under pressure through main pressure line 236. The pressurized hydraulic fluid goes through a pressure relief valve 238 before reaching the control components. If fluid flow is blocked or restricted through the control components sufficiently to cause the pressure in line 236 to exceed a preset threshold in pressure relief valve 238, it returns to tank 232 via return line 240.

Fluid flow splitters 242 direct pressurized hydraulic fluid at selected respective flow rates to the feed drum motor 46 and meter roller motor 228 via respective branch pressure lines 244, 277, and to the reciprocal feed motor 28 via branch line 246 (assuming an embodiment comprising two separate hydraulic motors 46 and 228 for driving the feed drum 36 and metering roller 35, as described above). Line 243 connects one output of flow splitter 242 to flow splitter 270 for the primary pressure feed to respective motors 46 and 228. The excess flow from splitter 242 is directed to drive reciprocal feed motor 28, and the excess flow from splitter 270 is directed to drive metering roller motor 228, as will be described in more detail below. The rates of flow to feed drum motor 46 and metering roller motor 228, and to reciprocal feed motor 28 as determined by adjustable rate controllers 248, 249 of flow splitter 242 and rate controllers 292, 294 of flow splitter 270 determine the speeds at which those motors drive those components, so the speeds of those components can be adjusted as desired to best handle any of a wide variety of materials to be comminuted, as described above.

The pressurized fluid in branch pressure line 244 is directed to the feed drum motor 46 through a three-position four-way valve 250. When the hand actuator 252 has the first valve spool position 254 aligned with branch pressure line 244, no fluid flows to feed drum motor 46, so the motor 46 is stopped. In this mode, the fluid flows through first spool position 254 and through bypass line 263 to branch return line 264 where it flows via main return line 266 back to tank. However, when the hand actuator shifts the spool to align second valve spool position 256 with branch pressure line 244, the pressurized fluid is directed via line 260 to the feed drum motor 46, which turns the feed drum 35 in the normal forward direction, as indicated by arrow 54 in FIG. 2. Return fluid flows via line 262, through valve 250, and via branch return line 264 and main return line 266 to tank 232. Alternatively, when hand actuator 252 shifts the valve spool to align the third position 258 with branch pressure line 244, the pressurized fluid crosses over and is fed to motor 46 via line 262 to drive the feed drum 36 in the reverse direction, which could, under some circumstances be useful for unplugging the metering apparatus 33.

The metering roller motor 228 can be operated in a similar manner with the excess flow from flow divider 270 providing pressurized fluid at an adjustably selected rate to another branch pressure line 272, where it is directed to a valve 274 with a hand-operated actuator 276. In the first spool position 278, fluid is blocked from flowing to motor 228, so it bypasses through the first spool position 278 and bypass line 285 to branch return line 286 and via main return line 266 back to tank 232, and the motor 228 does not turn. However, when valve 274 is in second mode 280, pressurized fluid is fed via line 288 to motor 228 to rotate meter roller 35 in the normal forward direction. Return fluid from motor 228 flows via line 290, through valve 274 and via branch return line 286 and main return line 266 to tank 232. In the third mode 282 of valve 274, the metering roller motor can be reversed.

The reciprocal feed motor 28 is operated with pressurized hydraulic fluid from branch pressure line 246, as mentioned above. The preferred operation of the reciprocal feed motor 28 is best described by reference not only to FIG. 9, but also to FIGS. 2 and 8. In general, it is desired that this operation be as convenient as possible for use with a front end loader L to dump batches of material to be comminuted into the chute 22. Such operation is most efficient when the feed plate 24 is at its starting position near the distal end 29 of chute 22 when the bucket B of front end loader L dumps a batch of material to be comminuted into the chute 22. Then, as the operator of the front end loader goes to refill the bucket B with another batch of material, the feed plate 24 should be pushing the batch just dumped into the metering apparatus 33. Preferably, that feeding operation is completed and the feed plate 24 is automatically returned to the starting position near the distal end 29 of chute 22 by the time the front end loader L arrives again with another batch of material to dump into the chute 22.

The above-described operation is accommodated by mounting the hand actuators 312, 322 of two pressure release detent-type control valves 310, 320, or a special purpose double spool valve having these features that result in the spools automatically shifting back to a neutral or home position in response to a pressure build-up, such as Model RD5000, manufactured by Cross Manufacturing, Inc., of Overland Park, Kansas, to protrude over the top edge of side wall 186, as illustrated in FIGS. 2 and 8. In FIG. 8, the valves 310, 320 and their respective actuators 312, 322 are in direct alignment, so one conceals the other, but their side-by-side relationship is shown in FIGS. 1 and 2. Referring again to FIG. 8, after the loader operator dumps a batch of material from bucket B into chute 22, he backs away with the lower edge of bucket B positioned to contact hand actuators 312, 322 of control valves 310, 320 and move them to their actuated positions represented by broken lines 312', 322'. Those actuated positions actuate control valves 310, 320 to cause reciprocating feed motor 28 to move feed plate 24 through chute 22 toward the metering apparatus 33 and then back to the starting position again, as will be described in more detail below.

Referring now primarily to the hydraulic control circuit of FIG. 9 with secondary reference to FIGS. 2 and 8, when the valves 310, 320 are in their respective first positions 314, 224, no pressurized fluid flows to reciprocal feed motor 28, so it is stopped, for example, with the feed plate 24 at its starting position near the distal end of chute 22. However, when the bucket B actuates the hand actuators 312, 322 of valves 310, 320, as described above, it moves the spools of those valves 310, 320 to their respective second positions 316, 326. In the first position 316 of valve 310, the branch pressure line 246 is connected to motor feed line 330 via line 332 and adjustable flow rate controller 334, so reciprocal feed motor 28 is actuated in its forward direction to move the feed plate 24 toward the metering apparatus 33. Return fluid flow from motor 38 is via line 336, second mode 316 in valve 310 and branch return line 338 to main return line 226 to tank 232.

The adjustable flow rate controller 334 adjusts the speed of motor 28, thus the speed of movement of feed plate 24, which, as described above, should be coordinated with the speeds of feed drum motor 46 and metering roller motor 228, depending on the nature of the material being comminuted and the available horsepower of the tractor being used to power the hammer mill 10. Excess fluid flow from adjustable flow rate controller is returned to tank 232 via line 239 and main return line 266.

When the feed plate 24 reaches its mechanical motion limit adjacent metering apparatus 33, the motor 28 is forced to stop, thus building up a back pressure in motor feed lines 330 and 332. That back pressure in a pressure release detent-type, valve 310, such as those described above, causes the spool in the valve 310 to shift back to its first position 314, which terminates fluid flow through motor feed lines 332 and 330, and redirects pressurized fluid flow via line 346 to valve 320, which, as discussed above, has already been activated to its second position mode 326 by the bucket B of front end loader L. Therefore, pressurized fluid is directed by valve 320 via secondary motor feed line 348 to motor 28. At the same time, the first mode of valve 310 blocks return flow through line 336, so pressurized fluid flows in the reverse direction through reciprocal feed motor 28, thereby causing it to operate in its reverse direction to return feed plate 24 automatically to its starting position near the distal end 29 of chute 22. Return fluid flow from motor 28 in its reverse mode to tank 232 is through one-way check valve 360, flow rate control 334, and return line 239 to main return line 266. Since the full flow of fluid from branch pressure line 246 is directed through motor 28 in this reverse mode, return of the feed plate 24 to its starting point near the distal end 29 of chute 22 is fairly rapid.

When the feed plate 24 reaches its mechanical motion limit, for example, by abutting bumper stops 207 shown in FIG. 1, the reciprocal feed motor 28 is forced to stop, which builds up a back pressure in secondary motor feed line 348. This back pressure in line 348 causes the spool of pressure release detent valve 320 back to its first mode, which redirects the fluid through bypass line 337 and branch return line 338 back to tank 232. Therefore, with no pressurized fluid being directed to motor 42, the motor 42 is stopped. The reciprocal feed motor 28 remains stopped while the operator of the front end loader L dumps another batch of material from bucket B into the chute 22 and then actuates the hand actuators 312, 322, again with bucket B, as described above, to start the cycle over again. Obviously the hand actuators 312, 322 can also be operated manually, if desired, such as if the chute is being filled by hand without the assistance of a front end loader L.

Figure 10:
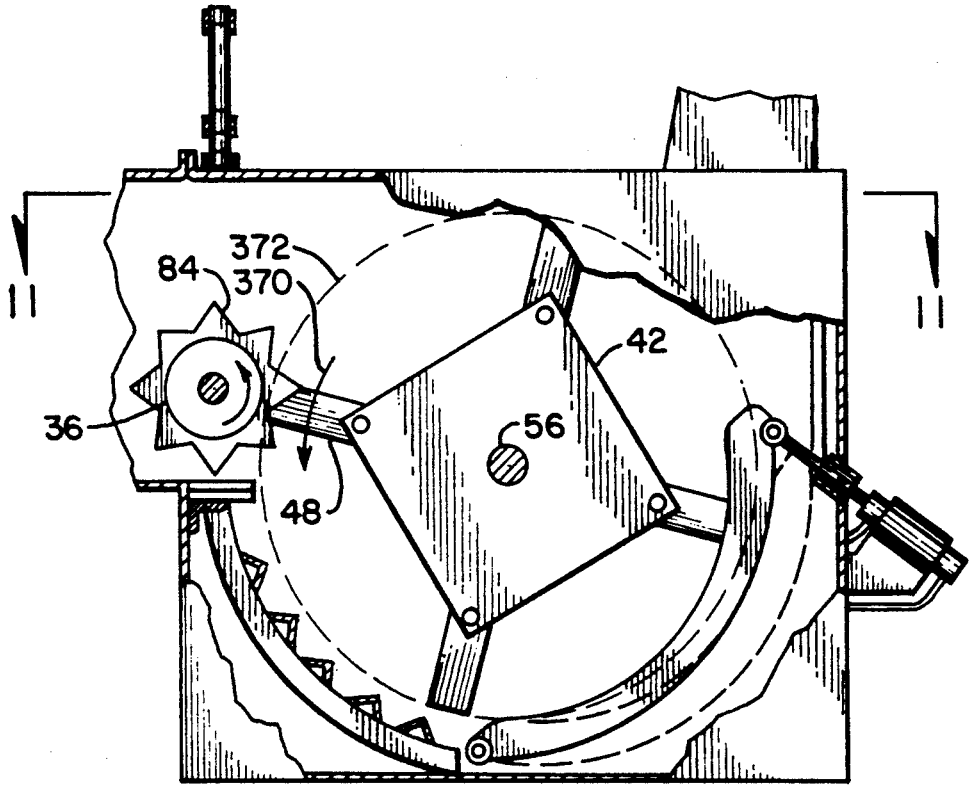
FIG. 10 is an elevation view of the grinder portion of the present invention with portions of the housing cut away to reveal an alternate embodiment feed drum arrangement and an actuator for adjusting the grinding ramps.
Figure 11:
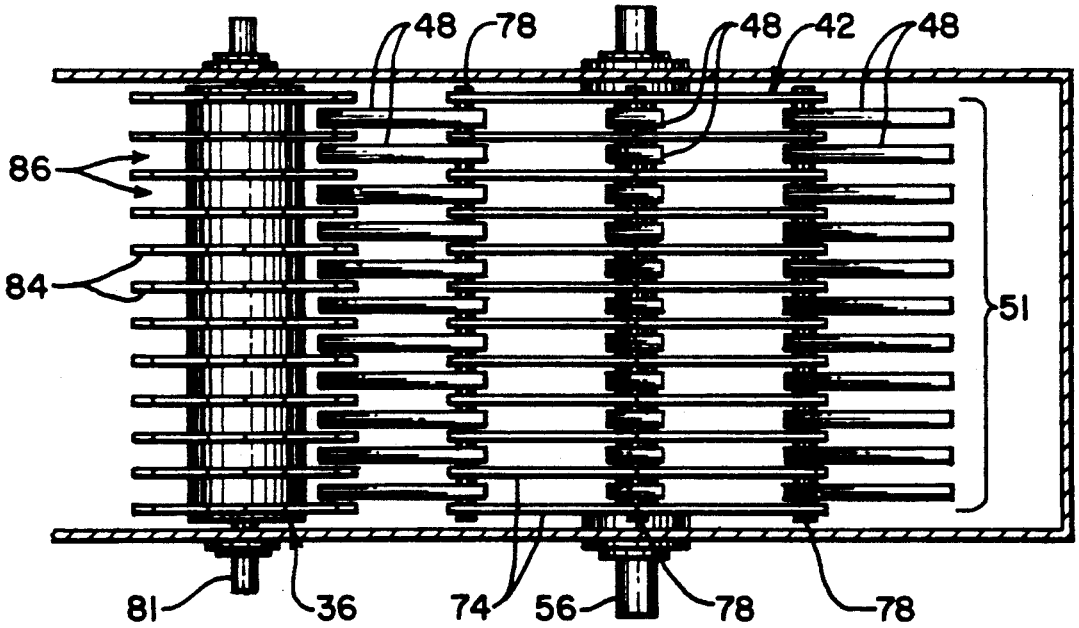
FIG. 11 is a cross-sectional view of the grinder portion taken along line 11—11 of FIG. 10 showing a plan view of the alternate embodiment feed drum arrangement of FIG. 10.

An alternate embodiment feed drum 36 position closer to the hammer mill rotor 42 is illustrated in FIGS. 10 and 11. In this embodiment, the previously described metering roller 35 is eliminated, and the feed drum 36 is positioned close enough to the hammer mill rotor 42 that the hammers 48 actually move through the spaces 86 between the teeth 84 of feed drum 36, as indicated by arrow 370 and hammer path 372. This alternate embodiment is particularly advantageous when comminuting materials such as wet leaves or muddy grass clippings and the like, which tend to stick and clog-up the spaces 86 between the teeth 84 of feed drum 36, because the hammers 48 keep those spaces 86 clean.

Figure 12:
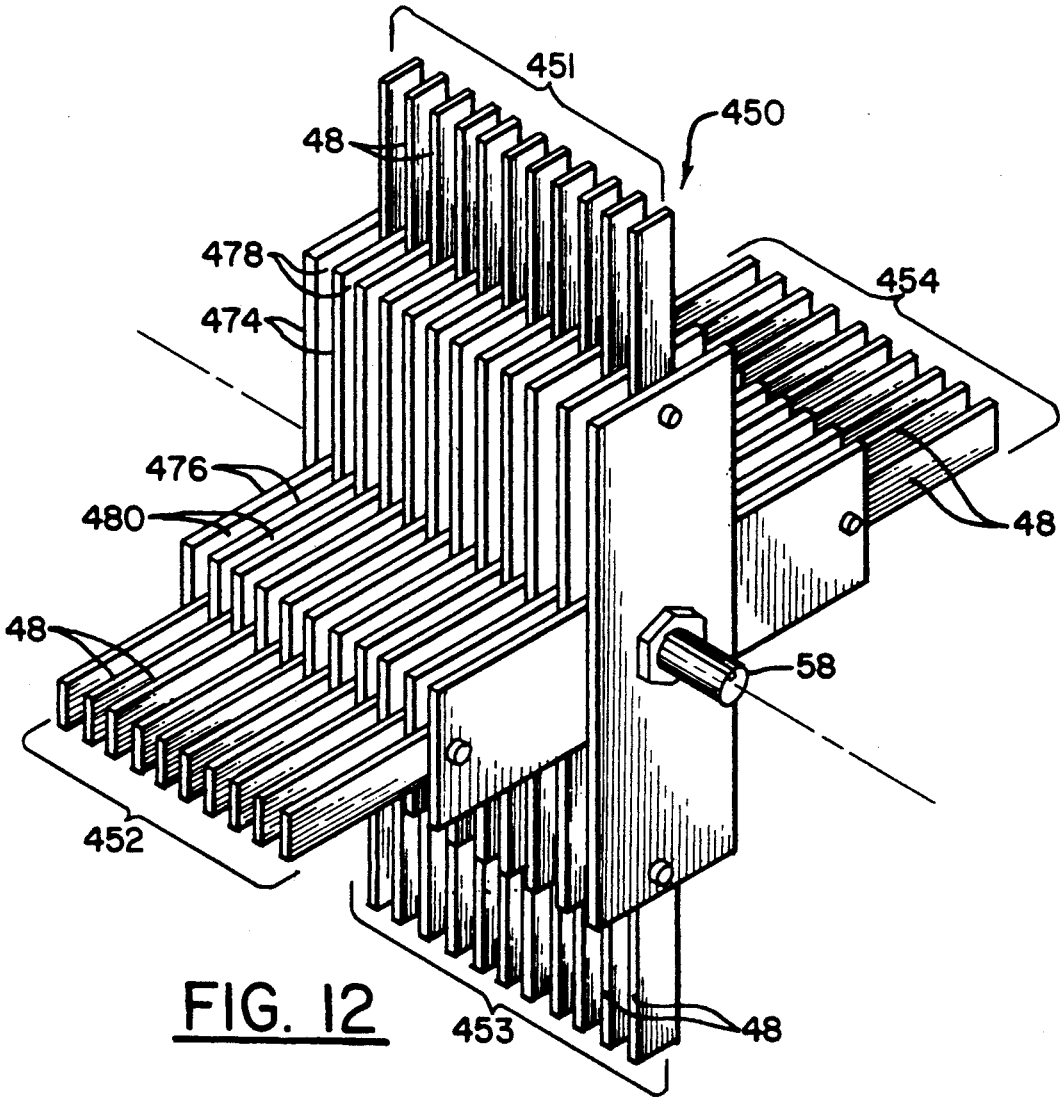
FIG. 12 is a perspective view of an alternate embodiment hammer mill rotor with offset hammers.

An alternate embodiment hammer mill rotor 450 is illustrated in FIG. 12, which is particularly advantageous for use in comminuting large diameter branches, logs, and posts. When comminuting such materials with the conventional hammer mill rotor 42 described above, the aligned hammers 48 tend to cut grooves in the logs as deep as the hammers 48 are long until the rotor plates 74 contact the material. At that point they can be prevented by the rotor plates 74 from feeding further into the hammer mill, and a jam can occur. The hammers 48 in this alternative embodiment rotor 450, however, are staggered such that the hammers 48 in gangs 451, 453 are laterally offset from the hammers in gangs 452, 454. These offset hammer alignments provide comminuting hammer contact with the entire cross-section of a large log, thus prevent the grooves from forming and eliminate the cause of jamming described above.

In this rotor embodiment 450, the rotor plates are more elongated. Alternate ones of the elongated plates 474 on which the hammers 48 in gangs 451, 453 are mounted are sandwiched between alternate ones of the plates 476 on which the hammers 48 in gangs 452, 454 are mounted. Further, the longitudinal axes of the elongated plates 474 are angularly spaced, for example orthogonal, from the longitudinal axes of the elongated plates 476. Therefore, spaces 478 formed between plates 474 by plates 476 are laterally offset from spaces 480 formed between plates 476 by plates 474. The hammers 48 in gangs 451, 453 are mounted in those spaces 478 and are therefore laterally offset from the hammers 48 in gangs 452, 454 mounted in the spaces 480. The plates 474, 476 are keyed to rotor shaft 58 to hold their respective angular positions.

Of course, the offset hammer positions of this rotor embodiment 450 could not be used with the closely spaced feed drum embodiment of FIGS. 10 and 11, and they could not be used to run between the elongated teeth 140 of the grinding ramp 40 illustrated in FIGS. 2 and 7. However, when comminuting logs, the feed drum cleaning problem discussed in relation to the FIGS. 10 and 11 embodiment and the need for the additional comminution provided by running the hammers between the elongated teeth 140 as illustrated in FIGS. 2 and 7 are not encountered. Therefore, the advantages provided by this alternate rotor embodiment 450 could be substantial in the circumstances described above. Also, the cumulative effect of the offset plates 474, 476, presents virtually a solid front to the air in grinding chamber 68 that they encounter, thus causing a substantially enhanced "wind flow" through the grinding chamber 68. Such enhanced wind flow can enhance particle carrying capacity and increase comminuting quality of many materials.

While the basic features have been shown and described, many modifications will become apparent to those skilled in the art that would be considered to fall within the scope of this invention. For example, any number of hammers 48 could be placed between the rotor plates. Of course, if this is done, there must be corresponding changes in the numbers of teeth 84 on feed drum 36 as well as grinding ramps 140 on ramp assembly 40. It would also be possible to replace the hammers 48 with other devices which would pulverize the refuse. Similarly, while the hammers 48 used in the preferred embodiment are replaceable, which is desirable, non-replaceable hammers, or combinations of hammers and knives could also be utilized. Numerous other modifications are also possible, and should also be considered as falling within the scope of the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be considered as falling within the scope of the invention as defined by the claims which follow.

The embodiments of the invention in which an exclusive property or privilege is claimed are defined as follows:

1. Grinder apparatus for comminuting fodder, feed grains, and wood materials, comprising:

a rotor assembly, including a horizontal main shaft that defines the axis of rotation of said rotor assembly and a plurality of grinding hammers extending radially outward at the periphery of said rotor assembly;

a main housing partially enclosing said rotor assembly in a milling chamber and leaving a portion of said rotor assembly not enclosed by said main housing:

rotor drive means connected to said rotor assembly for imparting high angular velocity rotary motion to said rotor assembly; and reciprocating feed means adapted for mounting on said main housing adjacent said rotor assembly for feeding materials to be comminuted into said milling chamber, said reciprocating feed means including a horizontal feed chute extending radially toward the portion of said rotor assembly not enclosed by said main housing, an adjustable cylindrical feed drum positioned at about the intersection of said horizontal feed chute with said milling chamber for engaging and metering said material into said milling chamber, and a linear reciprocating feed plate slidably mounted in said horizontal feed chute for moving said material towards said adjustable cylindrical feed drum.

2. The grinder apparatus of claim 1, wherein said adjustable cylindrical feed drum is mounted on a horizontal drum shaft with drum drive means connected to said shaft for rotating said adjustable cylindrical feed drum at a preselected speed.

3. The grinder apparatus of claim 2, wherein said reciprocating feed means includes a feeder housing portion that mounts over and encloses said portion of said rotor assembly not enclosed by said main housing and defining a variable feeder opening into said milling chamber that is spaced radially outwardly from the portion of said rotor assembly not enclosed by said main housing, the bottom of which opening is aligned with a horizontal plane that extends below said main shaft and the top of which aligns substantially horizontally with the top of said rotor assembly, said adjustable cylindrical feed drum being positioned in said opening with a spaced distance radially outward from said rotor assembly with said drum shaft parallel to said main shaft.

4. The grinder apparatus of claim 3, including adjusting means attached to said adjustable cylindrical feed drum and said drum shaft for moving said drum shaft along a drum axis.

5. The grinder apparatus of claim 4, wherein said adjusting means includes a pair of guide tubes in parallel, spaced apart relation on each side of the feeder housing, each of said guide tubes having a proximal end attached to said drum shaft and a distal end, an upper cross member attached to the distal ends of said guide tubes a spaced distance above said feeder housing, a lower cross member slidably mounted between said guide tubes substantially midway between the proximal and distal ends of said guide tubes and attached to said feeder housing, a middle cross member attached to said guide tubes between said upper cross member and said lower cross member, and a jack screw connected to said upper cross member and said middle cross member for changing the distance between said upper cross member and said middle cross member.

6. The grinder apparatus of claim 5, including bias means connected to said drum shaft for biasing said adjustable cylindrical feed drum along said drum axis toward said horizontal feed chute.

7. The grinder apparatus of claim 6, wherein said bias means includes a coiled tension spring connected at its one end to said middle cross member and anchored at its other end to said lower cross member.

8. The grinder apparatus of claim 7, wherein said horizontal feed chute has a proximal end where said feed chute joins said milling chamber and a distal end extending radially outward in relation to said rotor assembly, and wherein said linear reciprocating feed plate slidably mounted in said horizontal feed chute is in an extended position when said feed plate is located substantially at said distal end and in a retracted position when said feed plate is located substantially at said proximal end of said horizontal feed chute, including feed plate drive means connected to said feed plate for moving said feed plate between its extended position and its retracted position.

9. The grinder apparatus of claim 8, wherein said feed plate drive means includes a chain connected to said feed plate, a sprocket mounted substantially at said proximal end of said horizontal feed chute connected to said chain, and a hydraulic motor mounted substantially at said proximal end and connected to said chain.

10. The grinder apparatus of claim 9, wherein said hammers are in the form of elongated bars that extend radially outward from the periphery of said rotor assembly, and wherein said hammers are mounted in a plurality of gangs, each gang having a plurality of hammers, said gangs being evenly distributed around the periphery of the rotor assembly to maintain a dynamic balance of the rotor assembly, and the hammers in each gang being spaced axially apart from each other.

11. The grinder apparatus of claim 10, including a ledger plate extending horizontally from the intersection of said horizontal feed chute and said milling chamber radially toward said rotor assembly.

12. The grinder apparatus of claim 11, wherein said ledger plate is selectively adjustable toward and away from said rotor assembly.

13. The grinder apparatus of claim 12, wherein said housing includes a curved bottom wall that has a radius of curvature slightly larger than the maximum radius of said rotor assembly and extends from said ledger plate at least 180 degrees around the bottom periphery of said rotor assembly, and a plurality of rigid, spaced-apart, elongated adjustable grinding teeth having a radius of curvature substantially the same as the maximum radius of said rotor assembly extending upwardly from the bottom of said curved bottom wall toward said rotor assembly, said grinding teeth being aligned to allow said hammers to pass through the spaces between said grinding teeth as said rotor assembly rotates.

14. The grinder apparatus of claim 13, wherein said rigid, grinding teeth are pivotally mounted at one end and are adjustable radially toward and away from said rotor assembly at the downstream end.

15. The grinder apparatus of claim 13, wherein said grinding teeth extend about 90 degrees around the bottom periphery of said rotor assembly and have serrated edges.

16. The grinder apparatus of claim 13, wherein said rigid grinding teeth are serrated.

17. The grinder apparatus of claim 1, including hollow discharge spout means connected to said housing and opening into said milling chamber for conducting comminuted material out of said milling chamber, wherein high velocity rotation of said rotor assembly in said milling chamber propels the comminuted material in a high velocity air stream, into said spout means.

18. Hammer mill apparatus for comminuting materials, comprising:

a rotor assembly, including a horizontal main shaft that defines the axis of rotation of said rotor assembly and a plurality of hammers in the form of elongated bars extending radially outward at the periphery of said rotor assembly, said hammers being mounted in a plurality of gangs, each gang having a plurality of hammers, said gangs being evenly distributed around the periphery of the rotor assembly to maintain dynamic balance of the rotor assembly, and the hammers of each gang being spaced axially apart from each other;

a main housing partially enclosing said rotor assembly in a milling chamber;

rotor drive means connected to said rotor assembly for imparting high angular velocity rotary motor to said rotor assembly;

reciprocating feeder means adjacent said rotor assembly for feeding materials to be comminuted into said milling chamber, said feeder means including a horizontal floor positioned adjacent the periphery of the portion of said rotor assembly that is not enclosed by said main housing; and a combination metering and grinding assembly comprised of a plurality of rigid, spaced apart, curved grinding ramps extending from under the floor radially into said rotor assembly, said ramps being aligned so that each of the hammers in a gang can pass between two of said ramps, and an adjustable cylindrical drum feeder comprised of a plurality of rigid, spaced apart grinding teeth mounted adjacent said rotor assembly in the portion of said rotor assembly that is not enclosed by said main housing, said grinding teeth on said drum feeder being aligned so that each of the hammers in a gang can pass between two of said teeth.

19. The hammer mill apparatus of claim 18, wherein said curved grinding ramps are adjustable to move said curved grinding ramps radially toward and away from said rotor assembly to selectively vary the extent to which said hammers pass between said curved grinding ramps.

20. Comminuting apparatus for comminuting materials, said apparatus comprising:

rotary milling means for comminuting the materials; and reciprocal feed apparatus positioned adjacent said rotary milling means for pushing the material into said rotary milling means, said reciprocal feed apparatus including an elongated chute that has two spaced apart side panels extending upwardly from a substantially horizontal floor panel, a reciprocally moveable feed plate in said chute, actuator apparatus positioned adjacent and extending upwardly to a distance above one of said side panels for manually initiating reciprocal movement of said feed plate and for stopping said reciprocal movement after each cycle of once toward said rotary milling means and once away from said rotary milling means, and drive means for moving said feed plate toward and away from said rotary milling means.

21. The comminuting apparatus of claim 20, including control means for manually initiating the reciprocal movement of said feed plate and for stopping said reciprocal movement after each cycle of once toward said rotary milling means and once away from said rotary milling means.

22. Comminuting apparatus for comminuting materials, comprising:

rotary milling means for comminuting materials;

reciprocal feed apparatus positioned adjacent said rotary milling means for pushing the materials into said rotary milling means, said reciprocal feed means including an elongated chute, a reciprocally moveable feed plate in said chute, and drive means for moving said feed plate toward and away from said rotary milling means; and metering means positioned between said reciprocal feed apparatus and said rotary milling means for metering the materials being pushed by said reciprocal feed apparatus into said rotary milling means.

23. The comminuting apparatus of claim 22, wherein said rotary milling means has a rotor mounted to rotate about a rotor axis, said chute has a floor panel and said metering means includes a rotary feed drum positioned above said floor panel and mounted to rotate about a drum axis that is substantially parallel to said rotor axis.

24. The comminuting apparatus of claim 23, wherein said metering means includes a metering roller positioned between said feed drum and said rotor and mounted to rotate about a metering roller axis that is substantially parallel to said rotor axis.

25. The comminuting apparatus of claim 24, wherein said metering roller is smaller in diameter than said feed drum.

26. The comminuting apparatus of claim 25, wherein said feed drum is moveable upwardly and downwardly in relation to said floor panel.

27. The comminuting apparatus of claim 26, wherein said metering roller is moveable upwardly and downwardly in relation to said floor panel.

28. The comminuting apparatus of claim 27, wherein said metering means includes a pair of arms spaced apart from each other with said feed drum and said metering roller positioned between and journaled in said arms.

29. The comminuting apparatus of claim 28, including adjusting means connected to said arms for adjusting said arms upwardly and downwardly in relation to said floor panel.

30. The comminuting apparatus of claim 29, wherein said metering roller is moveable upwardly and downwardly in relation to said arms.

31. The comminuting apparatus of claim 36, wherein said adjusting means includes first bias means for biasing said arms toward said floor panel.

32. The comminuting apparatus of claim 31, wherein said adjusting means includes second bias means for biasing said metering roller toward said floor panel in relation to said arms.

33. Comminuting apparatus for comminuting materials, said apparatus comprising:

A rotor mounted on a horizontal shaft that defines the axis of rotation of the rotor and a plurality of hammers angularly disbursed around the periphery of said rotor; p1 an elongated chute with two spaced apart side panels extending upwardly from a substantially horizontal floor panel that extends to a position adjacent the periphery of said rotor and lays in a plane that extends into said rotor slightly below said axis of rotation and substantially above the bottom of the rotor, the distance between said plane and said axis of rotation being less than the distance between said plane and the bottom of the rotor; a reciprocally moveable feed plate in said chute, and drive means for moving said feed plate toward and away from said rotor.

34. Comminuting apparatus for comminuting materials, said apparatus comprising:

rotary milling means for comminuting materials;

an elongated chute with two spaced apart side panels extending upwardly from a substantially horizontal floor panel that extends to a position adjacent said rotary milling means;

a reciprocally moveable feed plate in said chute, said feed plate being foldable from an upright position that is substantially perpendicular to said floor panel to a position substantially parallel to said floor panel; and drive means for moving said feed plate toward and away from said rotary milling means.

35. Comminuting apparatus for comminuting materials, said apparatus comprising:

rotary milling means for comminuting materials;

an elongated chute with two spaced apart side panels extending upwardly from a substantially horizontal floor panel that extends to a position adjacent said rotary milling means, said chute having an elongated slot in each of said side panels just above the floor panel and extending substantially the length of said chute;

a support plate slideably positioned in said chute with lateral extensions that extend in opposite directions from said support plate through said slots in said side panels and a reciprocally moveable feed plate extending substantially vertically from said support plate in said chute; and drive means for moving said feed plate toward and away from said rotary milling means, said drive means including a pair of roller chains positioned respectively on opposite outsides of said chute and adjacent said respective slots in said side panels and attached to said respective lateral extensions, said roller chains being large enough to substantially occlude said slots.

* * * * *